US009461356B2

(12) United States Patent
Yurugi et al.

(10) Patent No.: US 9,461,356 B2
(45) **Date of Patent: *Oct. 4, 2016**

(54) DUAL-BAND INVERTED-F ANTENNA APPARATUS PROVIDED WITH AT LEAST ONE ANTENNA ELEMENT HAVING ELEMENT PORTION OF HEIGHT FROM DIELECTRIC SUBSTRATE

(71) Applicant: PANASONIC INTELLECTUAL PROPERTY MANAGEMENT CO., LTD., Osaka (JP)

(72) Inventors: Hiroyuki Yurugi, Osaka (JP); Wataru Noguchi, Hyogo (JP); Masahiko Nagoshi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 537 days.

This patent is subject to a terminal disclaimer.

(21) Appl. No.: 13/669,829

(22) Filed: Nov. 6, 2012

(65) Prior Publication Data

US 2013/0063318 A1 Mar. 14, 2013

Related U.S. Application Data

(63) Continuation of application No. PCT/JP2012/001500, filed on Mar. 5, 2012.

(30) Foreign Application Priority Data

Jun. 2, 2011 (JP) ..... 2011-123933

(51) Int. Cl.
*H01Q 1/24* (2006.01)
*H01Q 9/42* (2006.01)
(Continued)

(52) U.S. Cl.
CPC ..... *H01Q 1/243* (2013.01); *H01Q 5/371* (2015.01); *H01Q 9/42* (2013.01); *H01Q 21/28* (2013.01)

(58) Field of Classification Search
CPC ..... H01Q 9/42; H01Q 5/357; H01Q 5/364; H01Q 5/371; H01Q 1/24; H01Q 1/241; H01Q 1/242; H01Q 1/245; H01Q 21/28
See application file for complete search history.

(56) References Cited

U.S. PATENT DOCUMENTS 6,008,762 A 12/1999 Nghiem
6,353,443 B1 3/2002 Ying
(Continued)

FOREIGN PATENT DOCUMENTS

CN 1308782 8/2001
CN 101297440 10/2008
(Continued)

OTHER PUBLICATIONS

International Search Report issued Jun. 5, 2012 in International (PCT) Application No. PCT/JP2012/001500.
(Continued)

*Primary Examiner* — Hoang V Nguyen
*Assistant Examiner* — Daniel J Munoz
(74) *Attorney, Agent, or Firm* — Wenderoth, Lind & Ponack, L.L.P.

(57) ABSTRACT

An antenna apparatus includes first and second antenna elements. The first antenna element operates as a loop antenna that resonates at a first wavelength, and the antenna apparatus operates as an inverted-F antenna that resonates at a second wavelength. The first antenna elements includes a first element portion formed to have a predetermined height from a surface of a dielectric substrate, and the second antenna element includes a second element portion which is formed to be substantially parallel to the first element portion at least at a predetermined distance apart from the first antenna element.

4 Claims, 13 Drawing Sheets

(51) Int. Cl.

| | |
|---|---|
| ***H01Q 21/28*** | (2006.01) |
| ***H01Q 5/00*** | (2015.01) |
| ***H01Q 5/371*** | (2015.01) |

(56) References Cited

U.S. PATENT DOCUMENTS

| | | | | |
|---|---|---|---|---|
| 6,670,925 | B2 | 12/2003 | Iwai et al. | |
| 7,026,999 | B2 | 4/2006 | Umehara et al. | |
| 8,035,563 | B2 | 10/2011 | Ishimiya | |
| 8,681,053 | B2 * | 3/2014 | Nagoshi et al. | 343/700 MS |
| 2001/0022559 | A1 | 9/2001 | Takahashi et al. | |
| 2002/0093456 | A1 | 7/2002 | Sawamura et al. | |
| 2002/0186169 | A1 | 12/2002 | Iwai et al. | |
| 2003/0169209 | A1 | 9/2003 | Ohara et al. | |
| 2004/0090377 | A1 | 5/2004 | Dai et al. | |
| 2004/0263396 | A1 * | 12/2004 | Sung | 343/702 |
| 2005/0093751 | A1 | 5/2005 | Tamaoka | |
| 2006/0017629 | A1 | 1/2006 | Ko et al. | |
| 2007/0001911 | A1 | 1/2007 | Fujio et al. | |
| 2007/0249313 | A1 | 10/2007 | Oshiyama et al. | |
| 2008/0100520 | A1 | 5/2008 | Ko et al. | |
| 2009/0009401 | A1 * | 1/2009 | Suzuki et al. | 343/700 MS |
| 2009/0231213 | A1 | 9/2009 | Ishimiya | |
| 2009/0231214 | A1 | 9/2009 | Mukouyama | |
| 2010/0117918 | A1 | 5/2010 | Wu et al. | |
| 2010/0245201 | A1 | 9/2010 | Hossain et al. | |
| 2010/0289709 | A1 | 11/2010 | Guan | |
| 2013/0162488 | A1 * | 6/2013 | Onaka et al. | 343/728 |

FOREIGN PATENT DOCUMENTS

| | | | |
|---|---|---|---|
| EP | 1 133 001 | A2 | 9/2001 |
| EP | 1 223 640 | A2 | 7/2002 |
| EP | 1 291 968 | A1 | 3/2003 |
| EP | 1 615 290 | A1 | 1/2006 |
| EP | 1 848 061 | A2 | 10/2007 |
| EP | 1 939 984 | A1 | 7/2008 |
| JP | 08-204431 | | 8/1996 |
| JP | 2001-358521 | | 12/2001 |
| JP | 2002-520936 | | 7/2002 |
| JP | 2002-319809 | | 10/2002 |
| JP | 2003-347828 | | 12/2003 |
| JP | 2004-201278 | | 7/2004 |
| JP | 2007-13643 | | 1/2007 |
| JP | 3958110 | | 5/2007 |
| JP | 2007-288649 | | 11/2007 |
| JP | 2008-141739 | | 6/2008 |
| JP | 2009-111999 | | 5/2009 |
| JP | 2010-239246 | | 10/2010 |
| WO | 00/03453 | | 1/2000 |

OTHER PUBLICATIONS

English translation of International Preliminary Report on Patentability issued Dec. 12, 2013 in International (PCT) Application No. PCT/JP2012/001500.

Japanese Office Action (OA) issued Jan. 7, 2014 in corresponding Japanese Patent Application No. 2012-548161.

Naoki Sawaguchi et al., "Dual-band Planner Inverted F Antenna with Embedded Filter", IEICE Technical Report, The Institute of Electronics, Information and Communication Engineers, MW2005-132, pp. 25-30, Dec. 2005, with its English abstract on the front page.

Partial Supplementary European Search Report issued Jan. 5, 2015 in corresponding European Patent Application No. 12777840.5.

Extended European Search Report issued May 13, 2015 in European Application No. 12777840.5.

Office Action and Search Report issued Feb. 28, 2015 in Chinese Application No. 201280001315.7, with partial English translation.

* cited by examiner

DUAL-BAND INVERTED-F ANTENNA APPARATUS PROVIDED WITH AT LEAST ONE ANTENNA ELEMENT HAVING ELEMENT PORTION OF HEIGHT FROM DIELECTRIC SUBSTRATE

This is a continuation application of International application No. PCT/JP2012/001500 as filed on Mar. 5, 2012, which claims priority to Japanese patent application No. JP 2011-123933 as filed on Jun. 2, 2011, the contents of which are incorporated herein by reference.

BACKGROUND OF THE INVENTION

1. Field of the Invention

The present disclosure relates to an antenna apparatuses. In particular, the present disclosure relates to a dual-band antenna apparatus.

2. Description of the Related Art

Background Art

In recent years, a style to wirelessly connect a plurality of apparatuses by utilizing a wireless LAN (Local Area Network) technology complying with the communication standard IEEE802.11 has become widespread, in the fields of AV (Audio and Visual) equipments such as television broadcasting receiver apparatuses and Blu-ray disc players, and the fields of personal computers. This allows the LAN network in an office or home to be wireless, and the user can view and listen to television broadcasting and enjoy the Internet without any bother with wiring.

Meanwhile, wireless communication equipments represented by portable telephones have spread rapidly, and the frequency bands used for the wireless LAN cover a plurality of frequency bands. For example, a 2.4-GHz band is used according to IEEE802.11b and IEEE802.11g, a 5-GHz band is used according to IEEE802.11a, and the 2.4-GHz band and the 5-GHz band are used according to IEEE802.11n. Therefore, it is desired that the antenna apparatus mounted on wireless communication equipment is a dual-band antenna apparatus, which can be used in, for example, both of the frequency bands of the 2.4-GHz band and the 5-GHz band. Further, when the antenna apparatus is built in wireless communication equipment, the antenna apparatus is required to have a small size so that the occupation space thereof in the equipment can be reduced in accordance with the size reduction and multifunctionality of the wireless communication equipment.

For example, the Patent Document 1 discloses a prior art antenna to satisfy the above-described requirements. FIG. 14 is a plan view showing a configuration of the prior art antenna. Referring to FIG. 14, the prior art antenna is configured to include a first antenna element 401 for a low frequency band of two frequency bands, and a second antenna element 402 for a high frequency band. One end of each of the first and second antenna elements 401 and 402 is connected to a feeding point 403. In this case, another end of the first antenna element 401 is an open end, and the electrical length of the first antenna element 401 is set to a half wavelength of a radio wave in the high frequency band. In addition, another end of the second antenna element 402 is connected to a grounding conductor 404, and the electrical length of the second antenna element 402 is set to a quarter wavelength of a radio wave in the low frequency band.

Referring to FIG. 14, an impedance of the second antenna element 402 is infinite in the low frequency band, and an impedance of the first antenna element 401 is infinite in the high frequency band. Therefore, the first and second antenna elements 401 and 402 do not interfere with each other, and deteriorations in the gain in each of the frequency bands can be prevented. For example, in mobile communications represented by, for example, portable telephones, GSM (registered trademark) (Global System for Mobile communication) that mainly use a 900-MHz band, and DCS (Digital Cellular System) that uses a 1.8-GHz band or PCS (Personal Communication Service) that uses a 1.9-GHz band are used. In particular, when the antenna of FIG. 14 is used in a combination of frequency bands such that the frequency of the high frequency band is two times the frequency of the low frequency band, one wavelength of radio waves in the high frequency band becomes a half of a wavelength of radio waves in the low frequency band. Therefore, electrical lengths of the first and second antenna elements 401 and 402 can be easily adjusted, and this leads to great effects. Prior art documents related to the present disclosure are listed below:

Patent Document 1: Japanese patent laid-open publication No. 2007-288649 A;

Patent Document 2: Specification of U.S. Pat. No. 6,008,762;

Patent Document 3: Specification of United States Patent Application Publication No. US 2010/0289709 A1;

Patent Document 4: Specification of United States Patent Application Publication No. US 2005/0093751 A1;

Patent Document 5: Japanese patent laid-open publication No. JP 2004-201278 A;

Patent Document 6: Japanese patent laid-open publication No. JP 2009-111999 A;

Patent Document 7: Japanese patent laid-open publication No. JP 2008-141739 A; and Patent Document 8: Japanese patent laid-open publication No. JP 3958110 B.

In the prior art antenna, it is desirable that the frequency of the high frequency band is two times the frequency of the low frequency band. On the other hand, in a case of the combination of the 2.4-GHz band ranging from 2.4 GHz to 2.483 GHz and the 5-GHz band ranging from 5.15 GHz to 5.85 GHz, the frequency in the 5-GHz band becomes up to about 2.5 times the frequency in the 2.4-GHz band. Therefore, the prior art antenna has not been able to be applied to the antenna for the 2.4-GHz band and the 5-GHz band as it is.

In addition, according to the prior art antenna, since the first antenna element 401 for the low frequency band is an inverted-L antenna, a sufficient fractional band-width cannot be generally secured in the low frequency band.

In addition, AV equipments such as a television broadcasting receiver apparatus, a Blu-ray Disc or DVD player, a recorder or the like are scarcely moved after they are set up. Therefore, when there is a bias in a directional pattern of the antenna mounted on such AV equipments, there is quite a possibility that the performance of the antenna cannot be sufficiently drawn out. For example, referring to FIG. 14, when the first and second antenna elements 401 and 402 are formed of conductor patterns on a plane identical to that of the grounding conductor 14 on the dielectric substrate, there is quite a possibility that a bias might be generated in a directional pattern of a vertical polarized wave perpendicular to the dielectric substrate. Therefore, the prior art antenna has not been appropriate for the AV equipments.

SUMMARY OF THE INVENTION

It is an object of the present disclosure to provide a dual-band antenna apparatus having a size smaller than that of the prior art, capable of solving the above-described problems, securing a desired fractional band-width in a low frequency band, providing a satisfactory antenna gain in each of the frequency bands, and providing a substantially omni-directional directional pattern in a high frequency band.

According to the first aspect of the present disclosure, there is provided an antenna apparatus which is an antenna apparatus of an inverted-F antenna including a first antenna element of a loop antenna and a second antenna element. The first antenna element has one end connected to a first feeding point and another end connected to a grounding conductor formed on a dielectric substrate, and resonates at a predetermined first wavelength. The second antenna element has one end connected to a predetermined connecting portion of the first antenna element and another end of an open end. The inverted-F antenna resonates at a predetermined second wavelength longer than the first wavelength. The first antenna element includes a first element portion formed to have a predetermined first height from a surface of the dielectric substrate. The second antenna element includes a second element portion which is formed to have the first height from the surface of the dielectric substrate, and is formed to be substantially parallel to the first element portion at a predetermined distance apart from the first antenna element.

In the above-described antenna apparatus, the first antenna element includes first to sixth strip conductors. The first strip conductor has one end connected to the first feeding point, and extends in a predetermined first direction from the one end of the first strip conductor on the dielectric substrate. The second strip conductor has one end connected to another end of the first strip conductor, and extends from the one end of the second strip conductor in a predetermined second direction perpendicular to the surface of the dielectric substrate. The third strip conductor has one end connected to another end of the second strip conductor, and extends from the one end of the third strip conductor in a direction opposite to the first direction. The fourth strip conductor has one end connected to another end of the third strip conductor, and extends from the one end of the fourth strip conductor in a third direction perpendicular to the first and second directions. The fifth strip conductor has one end connected to another end of the fourth strip conductor, and extends from the one end of the fifth strip conductor to the surface of the dielectric substrate in a direction opposite to the second direction. The sixth strip conductor has one end connected to another end of the fifth strip conductor and another end connected to the grounding conductor. The second antenna element includes seventh to ninth strip conductors. The seventh strip conductor has one end connected to a connecting point between the second and third strip conductors, and extends from the one end of the seventh strip conductor in the third direction. The eighth strip conductor has one end connected to another end of the seventh strip conductor, and extends from the one end of the eighth strip conductor to the surface of the dielectric substrate in a direction opposite to the second direction. The ninth strip conductor has one end connected to another end of the eighth strip conductor, and extends from the one end of the ninth strip conductor to the open end in a direction opposite to the third direction. The first element portion is the fourth strip conductor, and the second element portion is the seventh strip conductor.

According to the second aspect of the present disclosure, there is provided an antenna apparatus, which is an antenna apparatus of an inverted-F antenna including a first antenna element of a loop antenna and a second antenna element. The first antenna element has one end connected to a first feeding point and another end connected to a grounding conductor formed on a dielectric substrate, and resonates at a predetermined first wavelength. The second antenna element has one end connected to a predetermined connecting portion of the first antenna element and another end of an open end. The inverted-F antenna resonates at a predetermined second wavelength longer than the first wavelength. The first antenna element includes a first element portion formed so that a height of the first antenna element from a surface of the dielectric substrate changes from a predetermined first height to a predetermined second height higher than the first height. The second antenna element includes a second element portion, which is formed to have the second height from the surface of the dielectric substrate, and is formed to have at least a predetermined distance apart from the first antenna element.

According to the third aspect of the present disclosure, there is provided an antenna apparatus, which is an antenna apparatus of an inverted-F antenna including a first antenna element of a loop antenna and a second antenna element. The first antenna element has one end connected to a first feeding point and another end connected to a grounding conductor formed on a dielectric substrate, and resonates at a predetermined first wavelength. The second antenna element has one end connected to a predetermined connecting portion of the first antenna element and another end of an open end. The inverted-F antenna resonates at a predetermined second wavelength longer than the first wavelength. The first antenna element includes a first element portion formed to have a predetermined first height from the surface of the dielectric substrate. The second antenna element includes a second element portion, which is formed on the surface of the dielectric substrate and is formed to be substantially parallel to the first element portion at a predetermined distance apart from the first antenna element.

In the above-described antenna apparatus, the distance is set to equal to or larger than 1/250 of the second wavelength.

In addition, in the above-described antenna apparatus, the first height is set to equal to or larger than 1/20 of the first wavelength.

According to the fourth aspect of the present disclosure, there is provided an antenna system including a first antenna apparatus that is the above-described antenna apparatus, and a second antenna apparatus. The second antenna apparatus includes a grounded antenna element, a third antenna element, a feeding antenna element, a fifth antenna element, and a fourth antenna element. The grounded antenna element has one end connected to the grounding conductor. The third antenna element is formed to be substantially parallel to an edge portion of the grounding conductor, and has one end connected to another end of the grounded antenna element. The feeding antenna element connects a second feeding point with a predetermined connecting point on the third antenna element. The fifth antenna element has one end connected to another end of the third antenna element. The fourth antenna element has one end connected to another end of the fifth antenna element. Another end of the fourth antenna element is folded, so that another end of the fourth antenna element is adjacent to and electromagnetically coupled to another end of the grounded antenna element to form a coupling capacitor between the fourth antenna element and the grounded antenna element. A first length, from the second feeding point via the feeding antenna element, the connecting point on the third antenna element and the third antenna element to another end of the third antenna element, is set to a length of a quarter wavelength of a first resonance frequency, so as to resonate a first radiating element having the first length at the first resonance frequency. A second length, from the second feeding point via the feeding antenna element, the connecting point on the third antenna element, the third antenna element, the fifth antenna element and the fourth antenna element to another end of the fourth antenna element, is set to a length of a quarter wavelength of the second resonance frequency, so as to generate a second radiating element having the second length at the second resonance frequency. A third length, from the second feeding point via the feeding antenna element, the connecting point on the third antenna element, the third antenna element, the fifth antenna element, the fourth antenna element and the coupling capacitor to the grounded antenna element, is set to one of a half wavelength and three quarter wavelength of the first resonance frequency, so as to resonate a third radiating element, which has the third length and configures a loop antenna, at the first resonance frequency. The third antenna element is formed so that a width of the third antenna element expands gradually in a tapered shape, from another end of the third antenna element to the connecting point between the third antenna element and the feeding antenna element.

According to the antenna apparatus of the present disclosure, the first antenna element includes the first element portion, and the second antenna element includes the second element portion. Therefore, it is possible to provide a dual-band antenna apparatus having a size smaller than that of the prior art, and capable of securing a desired fractional band-width in a low frequency band, providing a satisfactory antenna gain in each of the frequency bands, and providing a substantially omni-directional directional pattern in a high frequency band.

BRIEF DESCRIPTION OF THE DRAWINGS

These and other objects and features of the present disclosure will become clear from the following description taken in conjunction with the preferred preferred embodiments thereof with reference to the accompanying drawings throughout which like parts are designated by like reference numerals, and in which.

DETAILED DESCRIPTION OF THE PREFERRED EMBODIMENTS

Figure 1:
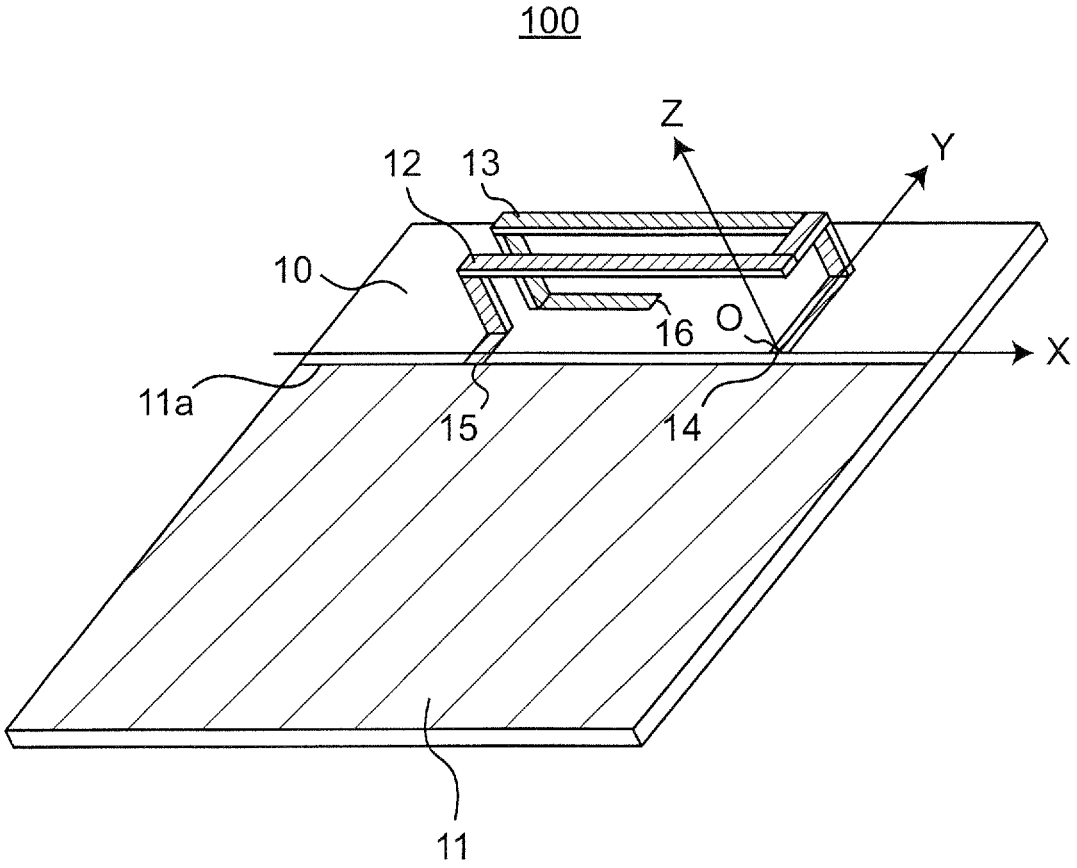
FIG. 1 is a perspective view showing a configuration of an antenna apparatus 100 according to a first preferred embodiment of the present disclosure.

Preferred embodiments of the present disclosure will be described hereinafter with reference to the drawings. In the preferred embodiments, components similar to each other are denoted by the same reference numerals.

First Preferred Embodiment

Figure 2:
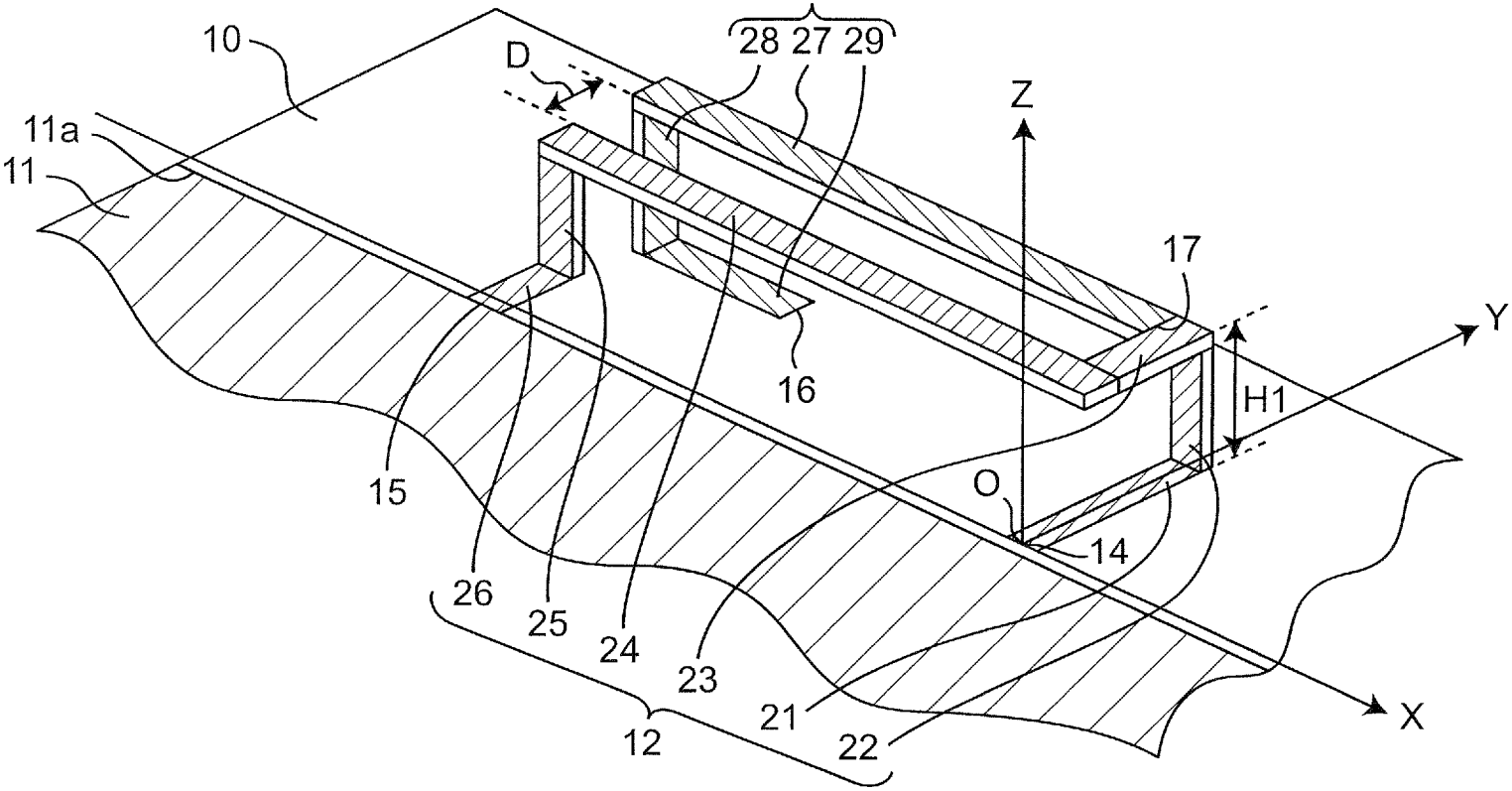
FIG. 2 is an enlarged perspective view showing the antenna apparatus 100 of FIG. 1.

FIG. 1 is a perspective view showing a configuration of an antenna apparatus 100 according to the first preferred embodiment of the present disclosure, and FIG. 2 is an enlarged perspective view showing the antenna apparatus 100 of FIG. 1. Referring to FIG. 1, the antenna apparatus 100 is mounted on a wireless communication apparatus such as a portable telephone. In addition, the antenna apparatus 100 is a dual-band antenna that can support two frequency bands for use in a wireless LAN, and resonates at a resonance frequency f1 of a low frequency band and a resonance frequency fh (when f1<fh) of a high frequency band. For example, the low frequency band is the 2.4-GHz band ranging from 2.4 GHz to 2.483 GHz, the high frequency band is the 5-GHz band ranging from 5.15 GHz to 5.85 GHz, the resonance frequency f1 is 2.4 GHz, and the resonance frequency fh is 5 GHz, in the present preferred embodiment.

Referring to FIG. 1, the antenna apparatus 100 is configured to include a dielectric substrate 10, a grounding conductor (ground portion) 11, a first antenna element 12, and a second antenna element 13. Referring to FIG. 1, the grounding conductor 11 is formed on an edge portion on a near side of a surface of the dielectric substrate 10 of, for example, a printed wiring board. In addition, the grounding conductor 11 has an edge portion 11*a* on a deep side of FIG. 1. Referring to FIG. 1 and FIGS. 2 to 11 as described later, each antenna apparatus is described hereinafter by using an XYZ coordinate system in which a feeding point 14 on the dielectric substrate 10 is defined as a coordinate origin O. In this case, in FIG. 1, an axis, which extends from the coordinate origin O in the rightward direction of FIG. 1 and is parallel to the edge portion 11*a*, is defined as an X axis. An axis, which extends from the coordinate origin O in an upper leftward direction of FIG. 1 and is perpendicular to the dielectric substrate 10, is defined as a Z axis. An axis, which extends from the coordinate origin O in an upper rightward direction of FIG. 1 and is perpendicular to the X axis and the Z axis, is defined as a Y axis. In addition, a direction opposite to the X-axis direction is referred to as a −X-axis direction, a direction opposite to the Y-axis direction is referred to as a −Y-axis direction, and a direction opposite to the Z-axis direction is referred to as a −Z-axis direction.

Referring to FIG. 2, the first antenna element 12 is configured to include a first strip conductor 21, a second strip conductor 22, a third strip conductor 23, a fourth strip conductor 24, a fifth strip conductor 25, and a sixth strip conductor 26. In addition, the second antenna element 13 is configured to include a seventh strip conductor 27, the eighth strip conductor 28, and a ninth strip conductor 29.

In this case, referring to FIG. 2, the first strip conductor 21 extends in the Y-axis direction from its one end connected to the feeding point 14, on the dielectric substrate 10. In addition, the second strip conductor 22 extends in the Z-axis direction from its one end connected to another end of the first strip conductor 21, within a plane parallel to the ZX plane. Further, the third strip conductor 23 extends in the −Y-axis direction from its one end connected to another end of the second strip conductor 22, within a plane parallel to the XY plane (the surface of the dielectric substrate 10). The fourth strip conductor 24 extends in the −X-axis direction from its one end connected to another end of the third strip conductor 23, within a plane parallel to the XY plane. In addition, the fifth strip conductor 25 extends in the −Z-axis direction from its one end connected to another end of the fourth strip conductor 24 to its another end on the surface of the dielectric substrate 10, within a plane parallel to the ZX plane. Then, the sixth strip conductor 26 extends in the −Y-axis direction from its one end connected to another end of the fifth strip conductor 25 on the dielectric substrate 10, and another end of the sixth strip conductor 26 is connected to a predetermined grounding point 15 on the edge portion 11*a* of the grounding conductor 11, to be grounded.

In addition, referring to FIG. 2, the seventh strip conductor 27 extends in the −X-axis direction from its one end connected to a connecting portion 17 at the one end of the third strip conductor 23, within a plane parallel to the XY plane. In addition, the eighth strip conductor 28 extends in the −Z-axis direction from its one end connected to another end of the seventh strip conductor 27 to another end on the surface of the dielectric substrate 10, within a plane parallel to the YZ plane. Then, the ninth strip conductor 29 extends in the X-axis direction from its one end connected to another end of the eighth strip conductor 28 to its another end of an open end 16, on the dielectric substrate 10.

In this case, the first strip conductor 21, the sixth strip conductor 26 and the ninth strip conductor 29 are formed as conductor patterns on the surface of the dielectric substrate 10. In addition, the second to fifth strip conductors 22 to 25, the seventh strip conductor 27 and the eighth strip conductor 28 are formed as conductor patterns on the respective surfaces of one rectangular parallelepiped (not shown) formed of a dielectric, for example.

The first antenna element 12 configured as described above has a folded loop shape from the feeding point 14 via the first to sixth strip conductors 21 to 26 to the grounding point 15. In particular, the first to third strip conductors 21 to 23 are formed in a C-figured shape perpendicular to the dielectric substrate 10. In addition, the first antenna element 12 has a height H1 that is substantially identical to the length of the second strip conductor 22. Further, each of the fifth strip conductor 25 and the eighth strip conductor 28 has a length identical to the length of the second strip conductor 22. In addition, the fourth strip conductor 24 and the seventh strip conductor 27 are formed to be substantially parallel to each other at a predetermined distance D, and the height H1 of the fourth strip conductor 24 from the surface of the dielectric substrate 10 and the height of the seventh strip conductor from the surface of the dielectric substrate 10 are substantially identical to each other.

The antenna apparatus 100 configured as described above has a first radiating element that can transmit and receive a wireless signal having a wireless frequency of a resonance frequency fh, and a second radiating element that can transmit and receive a wireless signal having a wireless frequency of a resonance frequency f1. In this case, the first radiating element is the first antenna element 12, which is the loop antenna that includes portions from the feeding point 14 via the first to sixth strip conductors 21 to 26, to another end of the sixth strip conductor 26 connected to the grounding point 15. The first radiating element resonates at a wavelength λh (length of 0 to 360 degrees (2 m) in terms of a sine wave) corresponding to the resonance frequency fh. The electrical length of the first radiating element is set to λh/2 that is substantially a half of the wavelength λh.

In addition, the second radiating element is an inverted-F antenna that has a main body part of the second antenna element 13, a feeding part from the feeding point 14 via the first strip conductor 21 and the second strip conductor 22 to the connecting portion 17 of the third strip conductor 23, and a short-circuit part from the connecting portion 17 via the third to sixth strip conductors 23 to 26 to the grounding point 15. In this case, the electrical length of the portion from the feeding point 14 via the first strip conductor 21, the second strip conductor 22, the seventh strip conductor 27, the eighth strip conductor 28 and the ninth strip conductor 29 to the open end 16 is set to λ¼, that is substantially a quarter of the wavelength λ1.

A setting method of the height H1 is described next. By setting the height is H1 to equal to or larger than 1/20 of the wavelength λh, it is possible to obtain a substantially omni-directional directional pattern of vertically polarized radio waves having the resonance frequency fh. In particular, in order to reduce the size of the antenna apparatus 100, it is proper to set the height H1 to λh/20. For example, when the resonance frequency fh is 5 GHz, the minimum value of the height H1 is calculated as follows by using the velocity c ($=3\times10^8$ [m/s]) of light.

$$H1=\lambda h/20=(c/fh)/20=3[\text{mm}]$$

Figure 3:
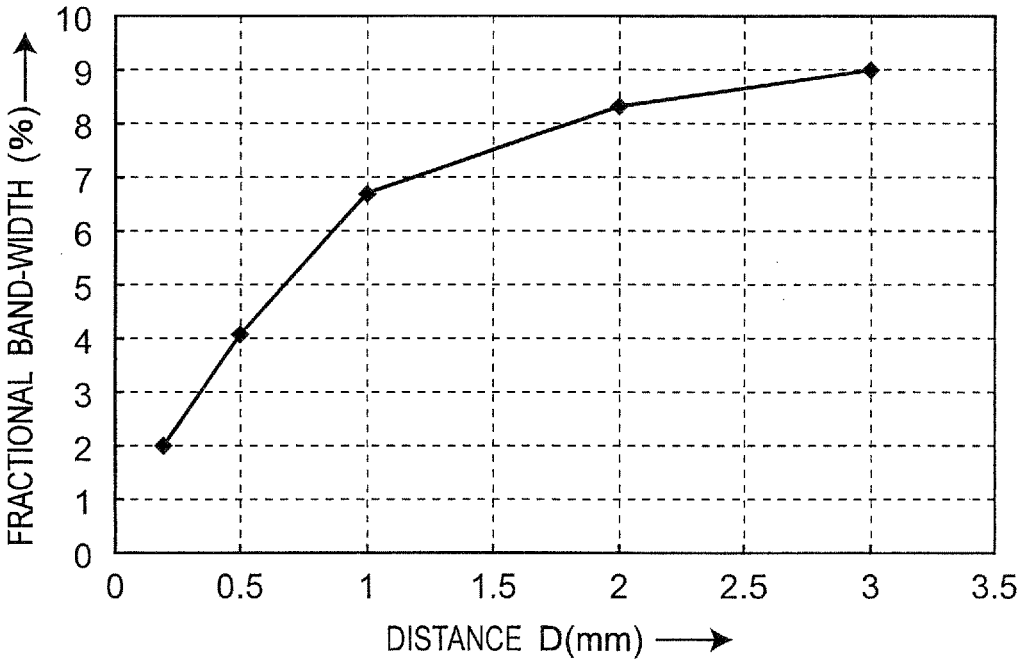
FIG. 3 is a graph showing a relation between a distance D of FIG. 2 and a fractional band-width in the 2.4-GHz band.

A setting method of the distance D is described next. FIG. 3 is a graph showing a relation between the distance D of FIG. 2 and a fractional band-width in the 2.4-GHz band. Referring to FIG. 3, the fractional band-width is a percentage obtained by dividing a band-width within which a voltage standing wave ratio (VSWR) becomes equal to or less than two in the vicinity of 2.4 GHz, by 2.45 GHz that is a substantial central value of the 2.4-GHz band. In the second radiating element of the inverted-F antenna that resonates at the resonance frequency f1, when the main body part of the second antenna element 13 and the short-circuit part from the connecting portion 17 via the third to sixth strip conductors 23 to 26 to the grounding point 15 are put close to each other, the interconnection between the main body part and the short-circuit part becomes strengthened. Then, the band-width of the band including the resonance frequency f1 becomes narrow, and a desired fractional band-width may not be obtained. For example, the desired fractional band-width is equal to or larger than about 3.5% in the 2.4-GHz band for use in the wireless LAN.

As apparent from FIG. 3, the fractional band-width becomes 3.5% when the distance D is about 0.5 mm, and the fractional band-width becomes larger as the distance D becomes larger. Therefore, it can be understood from FIG. 3 that the distance D is required to be equal to or larger than about 0.5 mm in order to make VSWR to equal to or less than two throughout the entire range of the 2.4-GHz band.

For example, when the resonance frequency f1 is 2.4 GHz, the wavelength λ1 is $c/f1=3\times10^8/(2.4\times10^9)=125$ [mm]. Therefore, the relation between the wavelength λ1 and the distance D is expressed by the following equation:

$$\lambda 1/D=125[\text{mm}]/0.5[\text{mm}]=250.$$

Namely, the distance D when VSWR becomes equal to or less than two throughout the entire range of the 2.4-GHz band is 1/250 of the wavelength λ1. In addition, as apparent from FIG. 3, the fractional band-width becomes larger as the distance D is made larger, and therefore, it is desirable to make a design in such a manner that the distance D is made as long as possible. Namely, the distance D should desirably be set to equal to or larger than 1/250 of the wavelength λ1.

Figure 4:
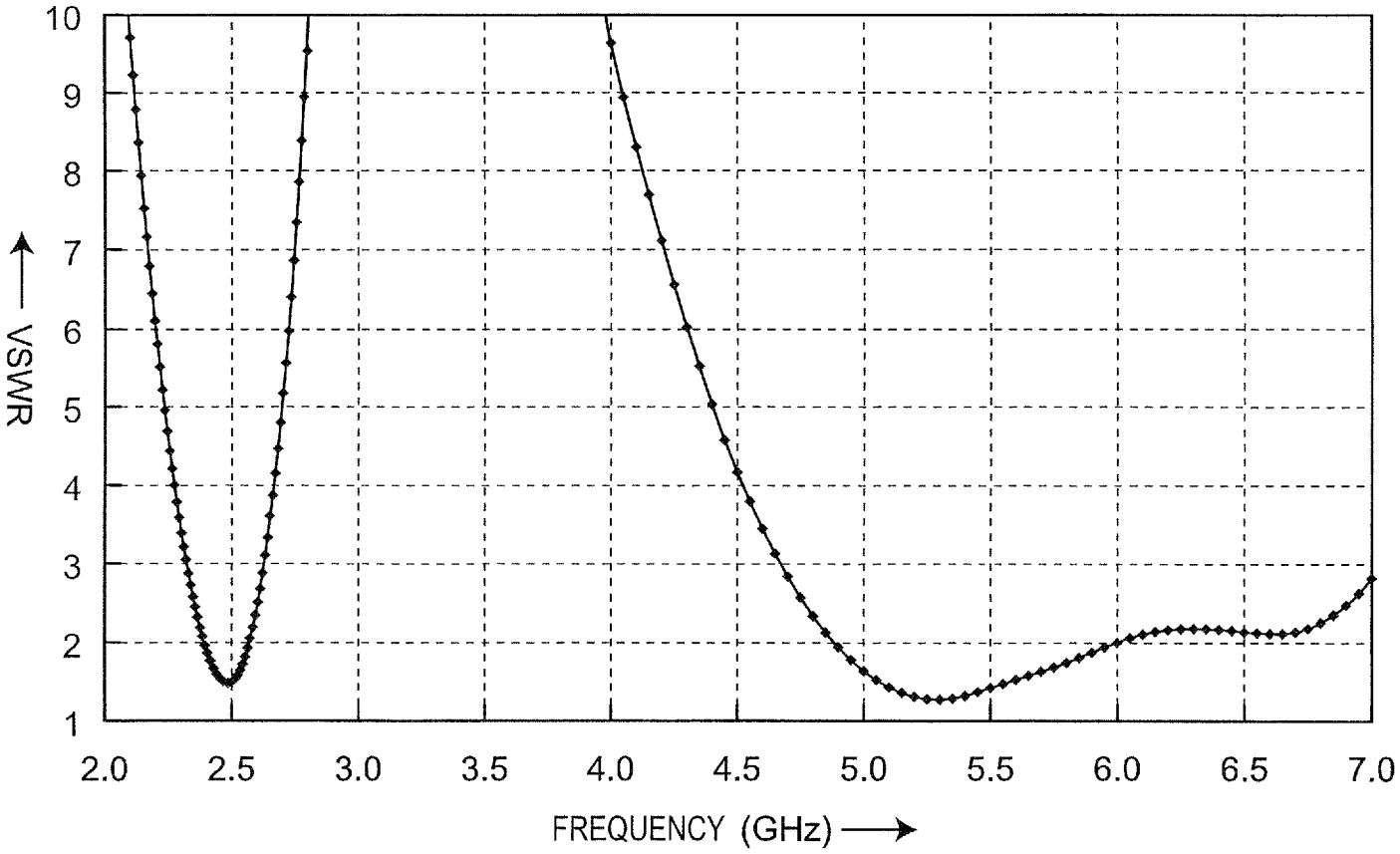
FIG. 4 is a graph showing frequency characteristic of a voltage standing wave ratio (VSWR) of the antenna apparatus 100 when the distance D of FIG. 2 is set to 1.0 mm.

FIG. 4 is a graph showing frequency characteristic of the voltage standing wave ratio of the antenna apparatus 100 when the distance D of FIG. 2 is set to 1.0 mm. The frequency bands for use in the wireless LAN are within a range of 2.4 GHz to 2.483 GHz and a range of 5.15 GHz to 5.85 GHz. According to FIG. 4, when the distance D is 1.0 mm, the VSWR of the antenna apparatus 100 is equal to or smaller than two within the range of 2.4 GHz to 2.483 GHz and the range of 5.15 GHz to 5.85 GHz, and it can be understood that the antenna apparatus 100 of the present preferred embodiment can be utilized sufficiently as a dual-band antenna for the wireless LAN.

Figure 5:
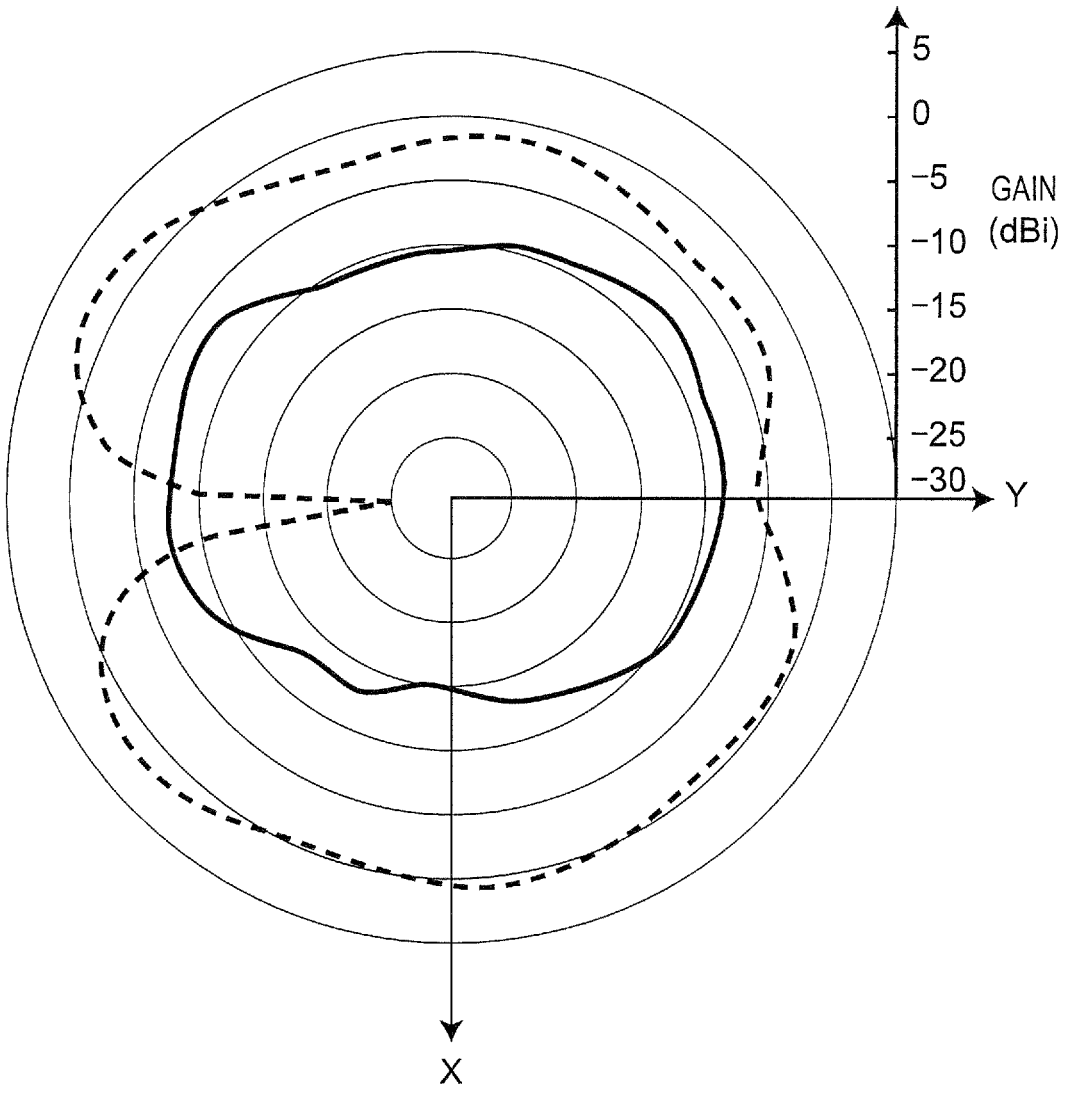
FIG. 5 is a graph showing directional patterns of a vertical polarized wave and a horizontal polarized wave at 5 GHz on an XY plane of the antenna apparatus of FIG. 1.

FIG. 5 is a graph showing directional patterns of a vertical polarized wave and a horizontal polarized wave at 5 GHz on the XY plane of the antenna apparatus of FIG. 1. Referring to FIG. 5, the solid line indicates the directional pattern of the vertical polarized wave, and the dashed line indicates the directional pattern of the horizontal polarized wave. As shown in FIG. 5, it can be understood that, a gain of about −10 dBi can be secured in average even for the vertical polarized wave on the XY plane, for which the antenna gain can hardly be secured in the antenna apparatus configured to include only conductor patterns formed on the dielectric substrate 10. In addition, it can be understood that the directional pattern of the vertical polarized radio waves is substantially omni-directional.

In the antenna apparatus 100 configured as described above, when the resonance frequency f1 is 2.4 GHz and the resonance frequency fh is 5 GHz, the wavelength λ1 is 0.125 [m], and the wavelength λh is 0.06 [m]. Therefore, it is proper to substantially set the electrical length of the first antenna element 12 that operates as the above-described loop antenna, to λh/2=0.06 [m]/2=30 [mm]. In addition, it is proper to substantially set the electrical length from the feeding point 14 via the first strip conductor 21, the second strip conductor 22 and the seventh to ninth strip conductors 27 to 29 to the open end 16, to λ½=0.125 [m]/4≈30 [mm].

Figure 14:
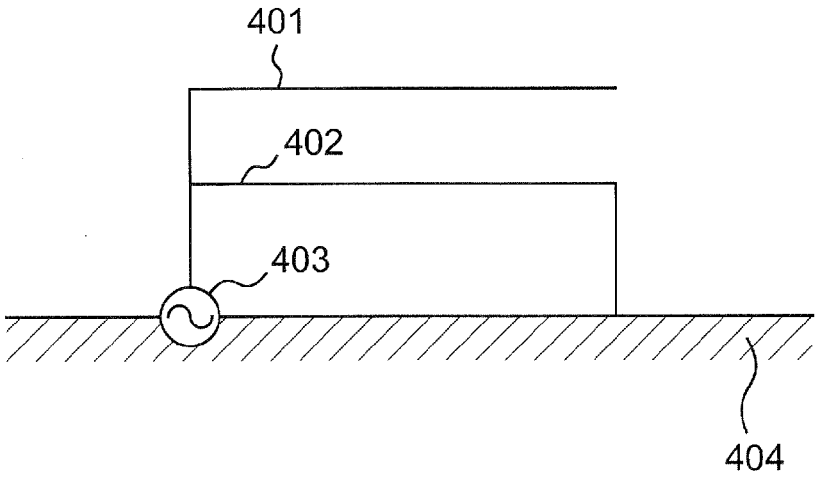
Fig.14 PRIOR ART
FIG. 14 is a plan view showing a configuration of a prior art antenna.

Concretely speaking, it is acceptable to set the length of the first strip conductor 21 to 6 [mm], to set the length of each of the second strip conductor 22, the fifth strip conductor 25 and the eighth strip conductor 28 to 3 [mm], to set the length of the third strip conductor 23 to 2 [mm], to set the length of the fourth strip conductor 24 to 17 [mm], and to set the length of the sixth strip conductor 26 to 3 [mm]. In this case, the size in the X-axis direction of the antenna apparatus 100 becomes 17 [mm], and the size in the Y-axis direction becomes 6 [mm]. When the first antenna element 12 and the second antenna element 13 are formed on the dielectric substrate 10 in a manner similar to that of the prior art antenna of FIG. 14, the size in the transverse direction of FIG. 14 becomes 22 [mm], and the size in the longitudinal direction of FIG. 14 becomes 8 [mm]. Therefore, according to the present preferred embodiment, the antenna size on the dielectric substrate 10 can be made smaller than that of the prior art.

As described above, according to the present preferred embodiment, it is possible to provide a antenna apparatus having a size smaller than that of the prior art, and capable of securing a desired fractional band-width in a low frequency band of two frequency bands, providing a satisfactory antenna gain in each of the frequency bands, and providing a substantially omni-directional directional pattern in a high frequency band. In particular, the antenna apparatus 100 of the present preferred embodiment can provide the substantially omni-directional directional pattern in the high frequency band, and therefore, the antenna apparatus 100 can be sufficiently utilized as an antenna apparatus for AV equipment.

First Modified Preferred Embodiment of First Preferred Embodiment

Figure 6:
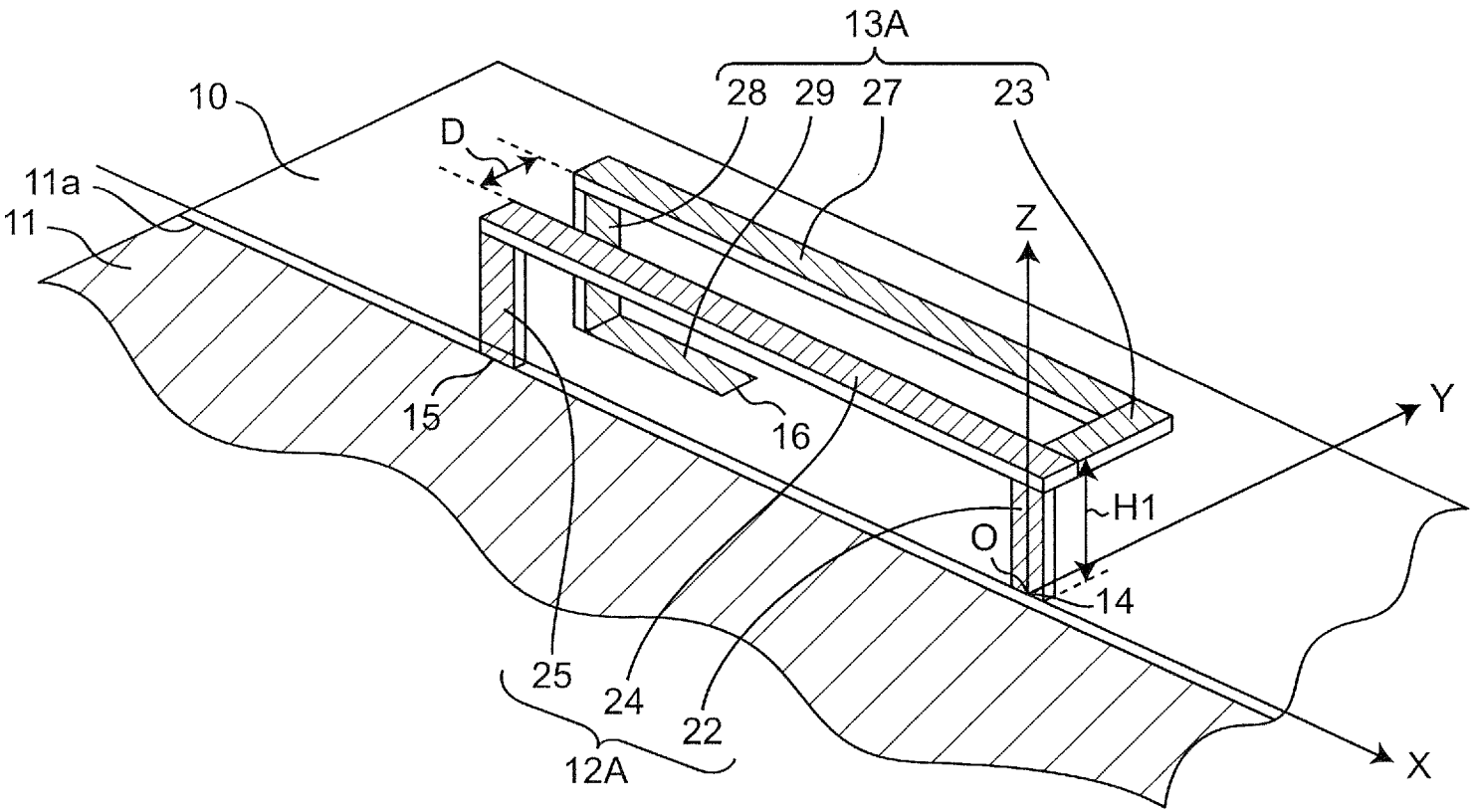
FIG. 6 is a perspective view showing a configuration of an antenna apparatus 100A according to a first modified preferred embodiment of the first preferred embodiment of the present disclosure.

FIG. 6 is a perspective view showing a configuration of an antenna apparatus 100A according to the first modified preferred embodiment of the first preferred embodiment of the present disclosure. A part of the first antenna element 12 is partially formed in the C-figured shape in the antenna apparatus 100 of the first preferred embodiment, however, the present disclosure is not limited to this. The antenna apparatus 100A of the present modified preferred embodiment is configured to include a first antenna element 12A and a second antenna element 13A instead of the first antenna element 12 and the second antenna element 13 as compared with the antenna apparatus 100.

Referring to FIG. 6, the antenna apparatus 100A is configured to include the dielectric substrate 10, the grounding conductor 11, the first antenna element 12A, and the second antenna element 13A. Further, the first antenna element 12A is configured to include the second strip conductor 22, the fourth strip conductor 24, and the fifth strip conductor 25. In addition, the second antenna element 13A is configured to include the third strip conductor 23, the seventh strip conductor 27, the eighth strip conductor 28, and the ninth strip conductor 29.

Referring to FIG. 6, the second strip conductor 22 extends in the Z-axis direction from its one end connected to the feeding point 14, within a plane parallel to the ZX plane. In addition, the fourth strip conductor 24 extends in the −X-axis direction from its one end connected to another end of the second strip conductor 22, within a plane parallel to the XY plane. Further, the fifth strip conductor 25 extends in the −Z-axis direction from its one end connected to another end of the fourth strip conductor 24, within a plane parallel to the ZX plane. Another end of the fifth strip conductor 25 is directly connected to the grounding point 15 without via the sixth strip conductor 26 (See FIG. 2), to be grounded.

In addition, referring to FIG. 6, the third strip conductor 23 extends in the Y-axis direction from its one end connected to one end of the fourth strip conductor 24, within a plane parallel to the XY plane. The seventh strip conductor 27 extends in the −X-axis direction from its one end connected to the connecting portion 17 at another end of the third strip conductor 23, within a plane parallel to the XY plane. In addition, the eighth strip conductor 28 extends in the −Z-axis direction from its one end connected to another end of the seventh strip conductor 27 to its another end on the surface of the dielectric substrate 10, within a plane parallel to the YZ plane. Then, the ninth strip conductor 29 extends in the X-axis direction from its one end connected to another end of the eighth strip conductor 28 to its another end of the open end 16 on the dielectric substrate 10.

Referring to FIG. 6, the first antenna element 12A has a height H1 substantially identical to the length of the second strip conductor 22. Further, each of the fifth strip conductor 25 and the eighth strip conductor 28 has a length identical to the length of the second strip conductor 22. In addition, the fourth strip conductor 24 and the seventh strip conductor 27 are formed to be substantially parallel to each other at a predetermined distance D, and the height H1 of the fourth strip conductor 24 from the surface of the dielectric substrate 10 and the height of the seventh strip conductor from the surface of the dielectric substrate 10 are substantially identical. It is noted that the distance D and the height H1 are set in a manner similar to that of the first preferred embodiment.

The antenna apparatus 100A configured as described above has a first radiating element that can transmit and receive a wireless signal having a wireless frequency of a resonance frequency fh, and a second radiating element that can transmit and receive a wireless signal having a wireless frequency of a resonance frequency f1. In this case, the first radiating element is the first antenna element 12A, which is a loop antenna that resonates at a wavelength λh corresponding to the resonance frequency fh. The electrical length of the first radiating element is set to λh/2 that is substantially a half of the wavelength λh.

In addition, the second radiating element is an inverted-F antenna that has a main body part of the second antenna element 13A, a feeding part of the second strip conductor 22, and a short-circuit part from a connecting point between the second strip conductor 22 and the fourth strip conductor 24 via the fourth strip conductor 24 and the fifth strip conductor 25 to the grounding point 15. In this case, the electrical length of the portion from the feeding point 14 via the second strip conductor 22, the third strip conductor 23, the seventh strip conductor 27, the eighth strip conductor 28 and the ninth strip conductor 29 to the open end 16 is set to λ¼ that is substantially a quarter of the wavelength λ1.

The antenna apparatus 100A of the present modified preferred embodiment exhibits action and advantageous effects similar to those of the antenna apparatus 100 of the first preferred embodiment.

Second Modified Preferred Embodiment of First Preferred Embodiment

Figure 7:
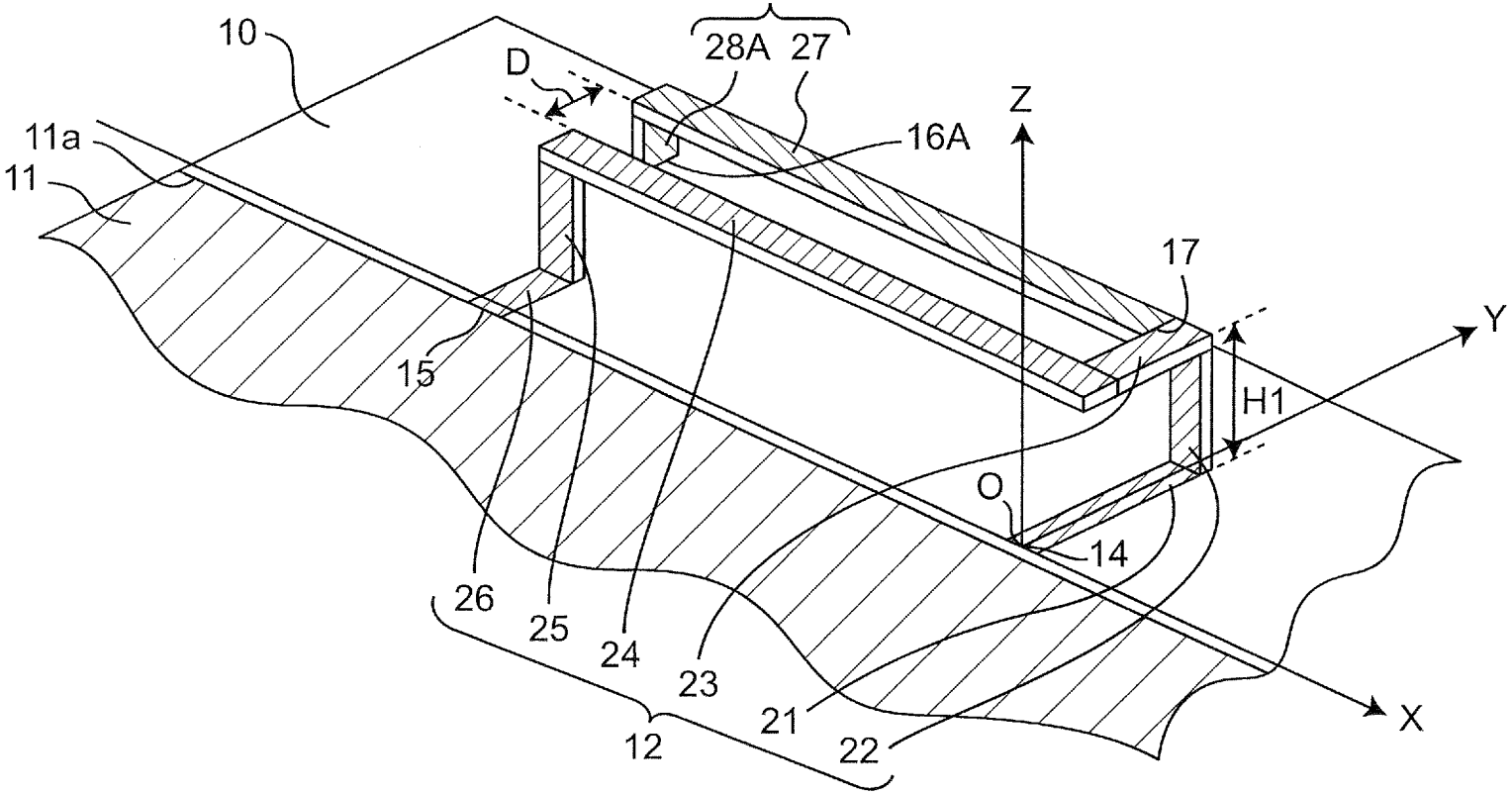
FIG. 7 is a perspective view showing a configuration of an antenna apparatus 100B according to a second modified preferred embodiment of the first preferred embodiment of the present disclosure.

The second antenna element 13 has the shape folded in the C-figured shape, and the open end 16 is provided on the dielectric substrate 10 in the antenna apparatus 100 of the first preferred embodiment, however, the present disclosure is not limited to this. FIG. 7 is a perspective view showing a configuration of an antenna apparatus 100B according to the second modified preferred embodiment of the first preferred embodiment of the present disclosure. The antenna apparatus 100B of the present modified preferred embodiment is different from the antenna apparatus 100 of the first preferred embodiment in the point that a second antenna element 13B is provided instead of the second antenna element 13.

Referring to FIG. 7, the antenna apparatus 100B is configured to include the dielectric substrate 10, the grounding conductor 11, the first antenna element 12, and the second antenna element 13B. In this case, the first antenna element 12 of FIG. 7 is configured in a manner similar to that of the first antenna element 12 of the antenna apparatus 100, and therefore, no description is provided therefor. The second antenna element 13B is configured to include the seventh strip conductor 27 and an eighth strip conductor 28A. The seventh strip conductor 27 extends in the −X-axis direction from its one end connected to the connecting portion 17 at one end of the third strip conductor 23, within a plane parallel to the XY plane. In addition, the eighth strip conductor 28A extends in the −Z-axis direction from its one end connected to another end of the seventh strip conductor 27, to its another end of an open end 16A, within a plane parallel to the YZ plane. As shown in FIG. 7, a length of the eighth strip conductor 28A is shorter than the length H1 of the second strip conductor 22, and the open end 16A is provided between the dielectric substrate 10 and another end of the seventh strip conductor 27.

Referring to FIG. 7, in a manner similar to that of the antenna apparatus 100, the fourth strip conductor 24 and the seventh strip conductor 27 are formed to be substantially parallel to each other at a predetermined distance D, and the height H1 of the fourth strip conductor 24 from the surface of the dielectric substrate 10 and the height of the seventh strip conductor from the surface of the dielectric substrate 10 are substantially identical. In addition, the distance D and the height H1 are each set in a manner similar to that of the first preferred embodiment.

The antenna apparatus 100B configured as described above has a first radiating element that can transmit and receive a wireless signal having a wireless frequency of a resonance frequency fh, and a second radiating element that can transmit and receive a wireless signal having a wireless frequency of a resonance frequency f1. In this case, the first radiating element is configured in a manner similar to that of the first radiating element of the antenna apparatus 100, and therefore, no description is provided therefor. The second radiating element is an inverted-F antenna that has a main body part of the second antenna element 13B, a feeding part from the feeding point 14 via the first strip conductor 21 and the second strip conductor 22 to the connecting portion 17 of the third strip conductor 23, and a short-circuit part from the connecting portion 17 via the third to sixth strip conductors 23 to 26 to the grounding point 15. In this case, the electrical length of the portion from the feeding point 14 via the first strip conductor 21, the second strip conductor 22, the seventh strip conductor 27 and the eighth strip conductor 28 to the open end 16A is set to 144 that is substantially a quarter of the wavelength λ1.

The antenna apparatus 100B of the present modified preferred embodiment exhibits action and advantageous effects similar to those of the antenna apparatus 100 of the first preferred embodiment.

Third Modified Preferred Embodiment of First Preferred Embodiment

Figure 8:
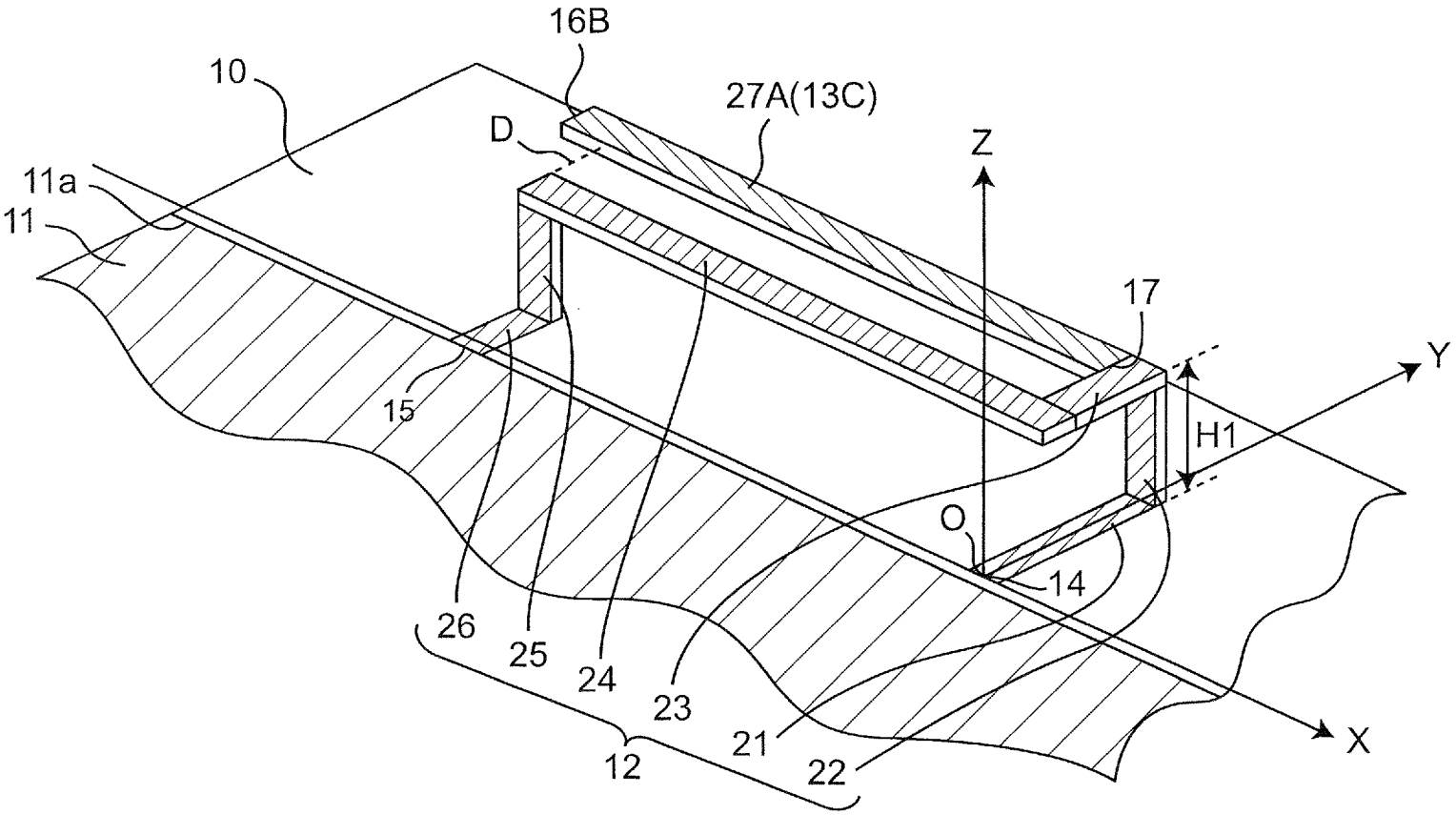
FIG. 8 is a perspective view showing a configuration of an antenna apparatus 100C according to a third modified preferred embodiment of the first preferred embodiment of the present disclosure.

The antenna apparatus 100 of the first preferred embodiment has the eighth strip conductor 28 and the ninth strip conductor 29, and the size in the X-axis direction of the first antenna element 12 and the size in the X-axis direction of the second antenna element are substantially equal to each other, however, the present disclosure is not limited to this. FIG. 8 is a perspective view showing a configuration of an antenna apparatus 100C according to the third modified preferred embodiment of the first preferred embodiment of the present disclosure. The antenna apparatus 100C of the present modified preferred embodiment is different from the antenna apparatus 100 of the first preferred embodiment in the point that a second antenna element 13C is provided instead of the second antenna element 13.

Referring to FIG. 8, the antenna apparatus 100C is configured to include the first antenna element 12 and the second antenna element 13C. In this case, the first antenna element 12 of FIG. 8 is configured in a manner similar to that of the first antenna element 12 of the antenna apparatus 100, and therefore, no description is provided therefor. The second antenna element 13C is configured to include a seventh strip conductor 27A. The seventh strip conductor 27A extends in the −X-axis direction from its one end connected to the connecting portion 17 at one end of the third strip conductor 23 to the open end 16B of its another end, within a plane parallel to the XY plane. As shown in FIG. 8, the open end 16B is located in the −X-axis direction from a connecting point between the fourth strip conductor 24 and the fifth strip conductor 25.

Referring to FIG. 8, in a manner similar to that of the antenna element 100, the fourth strip conductor 24 and the seventh strip conductor 27A are formed to be substantially parallel to each other at a predetermined distance D, and the height H1 of the fourth strip conductor 24 from the surface of the dielectric substrate 10 and the height of the seventh strip conductor from the surface of the dielectric substrate 10 are substantially identical. In addition, the distance D and the height H1 are each set in a manner similar to that of the first preferred embodiment.

The antenna apparatus 100C configured as described above has a first radiating element that can transmit and receive a wireless signal having a wireless frequency of a resonance frequency fh, and a second radiating element that can transmit and receive a wireless signal having a wireless frequency of a resonance frequency f1. In this case, the first radiating element is configured in a manner similar to that of the first radiating element of the antenna apparatus 100, and therefore, no description is provided therefor. The second radiating element is an inverted-F antenna that has a main body part of the second antenna element 13C, a feeding part from the feeding point 14 via the first strip conductor 21 and the second strip conductor 22 to the connecting portion 17 of the third strip conductor 23, and a short-circuit part from the connecting portion 17 via the third to sixth strip conductors 23 to 26 to the grounding point 15. In this case, the electrical length of the portion from the feeding point 14 via the first strip conductor 21, the second strip conductor 22 and the seventh strip conductor 27A to the open end 16B is set to λ¼ that is substantially a quarter of the wavelength λ1.

The antenna apparatus 100C of the present modified preferred embodiment exhibits action and advantageous effects similar to those of the antenna apparatus 100 of the first preferred embodiment.

Second Preferred Embodiment

Figure 9:
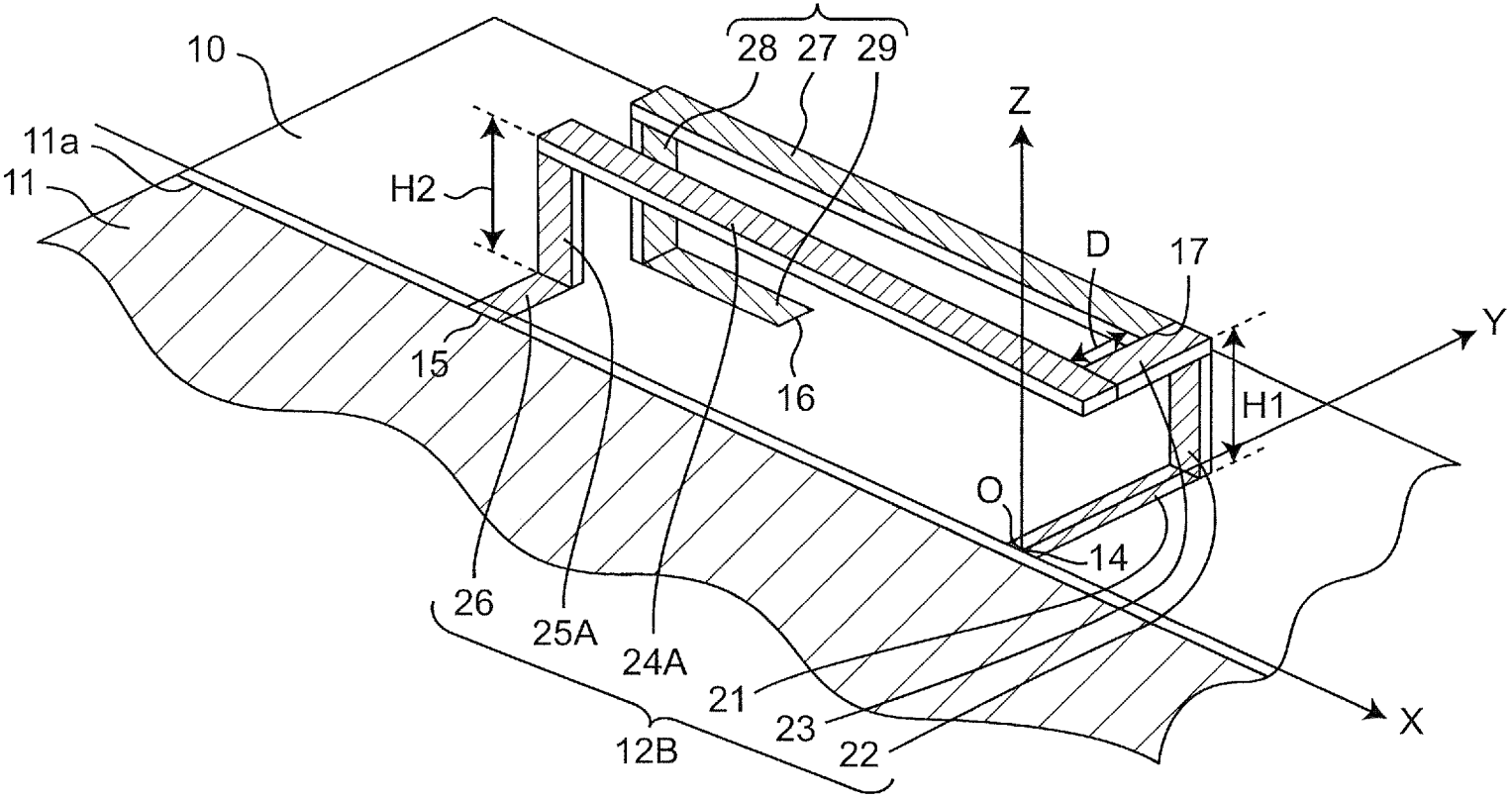
FIG. 9 is a perspective view showing a configuration of an antenna apparatus 100D according to a second preferred embodiment of the present disclosure.

The fourth strip conductor 24 is formed at the position of the height H1 from the dielectric substrate 10 in the first preferred embodiment and its modified preferred embodiments, however, the present disclosure is not limited to this. FIG. 9 is a perspective view showing a configuration of an antenna apparatus 100D according to the second preferred embodiment of the present disclosure. The antenna apparatus 100D of the second preferred embodiment is different from the antenna apparatus 100 of the first preferred embodiment in the point that the first antenna element 12B is provided instead of the first antenna element 12.

Referring to FIG. 9, the antenna apparatus 100D is configured to include the dielectric substrate 10, the grounding conductor 11, the first antenna element 12B, and the second antenna element 13. In this case, the second antenna element 13 of FIG. 9 is configured in a manner similar to that of the second antenna element 13 of the antenna apparatus 100, and therefore, no description is provided therefor. The first antenna element 12B is configured to include the first strip conductor 21, the second strip conductor 22, the third strip conductor 23, the fourth strip conductor 24A, the fifth strip conductor 25A, and the sixth strip conductor 26.

Referring to FIG. 9, the first strip conductor 21 extends in the Y-axis direction from its one end connected to the feeding point 14 on the dielectric substrate 10. In addition, the second strip conductor 22 extends in the Z-axis direction from its one end connected to another end of the first strip conductor 21, within a plane parallel to the ZX plane. Further, the third strip conductor 23 extends in the axis direction from its one end connected to another end of the second strip conductor 22, within a plane parallel to the XY plane. The fourth strip conductor 24A extends in the −X-axis direction and the Z-axis direction from its one end connected to another end of the third strip conductor 23. In addition, the fifth is strip conductor 25A extends in the −Z-axis direction from its one end connected to another end of the fourth strip conductor 24A to its another end on the surface of the dielectric substrate 10, within a plane parallel to the ZX plane. Then, the sixth strip conductor 26 extends in the −Y-axis direction from its one end connected to another end of the fifth strip conductor 25A on the dielectric substrate 10, and another end of the sixth strip conductor 26 is connected to the predetermined grounding point 15 on the edge portion 11*a* of the grounding conductor 11, to be grounded. It is noted that the length of the fifth strip conductor 25A is set to H2 (>H1).

Referring to FIG. 9, a distance D between a connecting point between one end of the third strip conductor 23 and the seventh strip conductor 27, and a connecting point between another end of the third strip conductor 23 and the fourth strip conductor 24 is set in a manner similar to that of the distance D of the first preferred embodiment. In addition, one end of the fourth strip conductor 24A has the height H1, and its another end has the height H12. The fourth strip conductor 24A is inclined in the X-axis direction with respect to the dielectric substrate 10. In this case, the height H1 is set in a manner similar to that of the height H1 of the first preferred embodiment.

The antenna apparatus 100D configured as described above has a first radiating element that can transmit and receive a wireless signal having a wireless frequency of a resonance frequency fh, and a second radiating element that can transmit and receive a wireless signal having a wireless frequency of a resonance frequency f1. In this case, the second radiating element of the present preferred embodiment is different from the second radiating element of the antenna apparatus 100 of the first preferred embodiment only in the point that the fourth strip conductor 24A and the fifth strip conductor 25A are provided instead of the fourth strip conductor and the fifth strip conductor 25, and therefore, no description is provided therefor.

In the present preferred embodiment, the first radiating element is the first antenna element 12B, which is a loop antenna including the portion, from the feeding point 14 via the first to third strip conductors 21 to 23, the fourth strip conductor 24A, the fifth strip conductor 25A and the sixth strip conductor 26, to another end of the sixth strip conductor 26 connected to the grounding point 15, and resonates at a wavelength λh corresponding to the resonance frequency fh. The electrical length of the first radiating element is set to λh/2 that is substantially a half of the wavelength λh.

The antenna apparatus 100D of the present preferred embodiment exhibits action and advantageous effects similar to those of the antenna apparatus 100 of the first preferred embodiment. Further, since the fourth strip conductor 24A and the fifth strip conductor 25A are provided according to the present preferred embodiment, the electrical length of the first radiating element can be lengthened, and the resonance frequency fh can be lowered without changing the size on the XY plane of the antenna apparatus 100D as compared with the first preferred embodiment.

Third Preferred Embodiment

Figure 10:
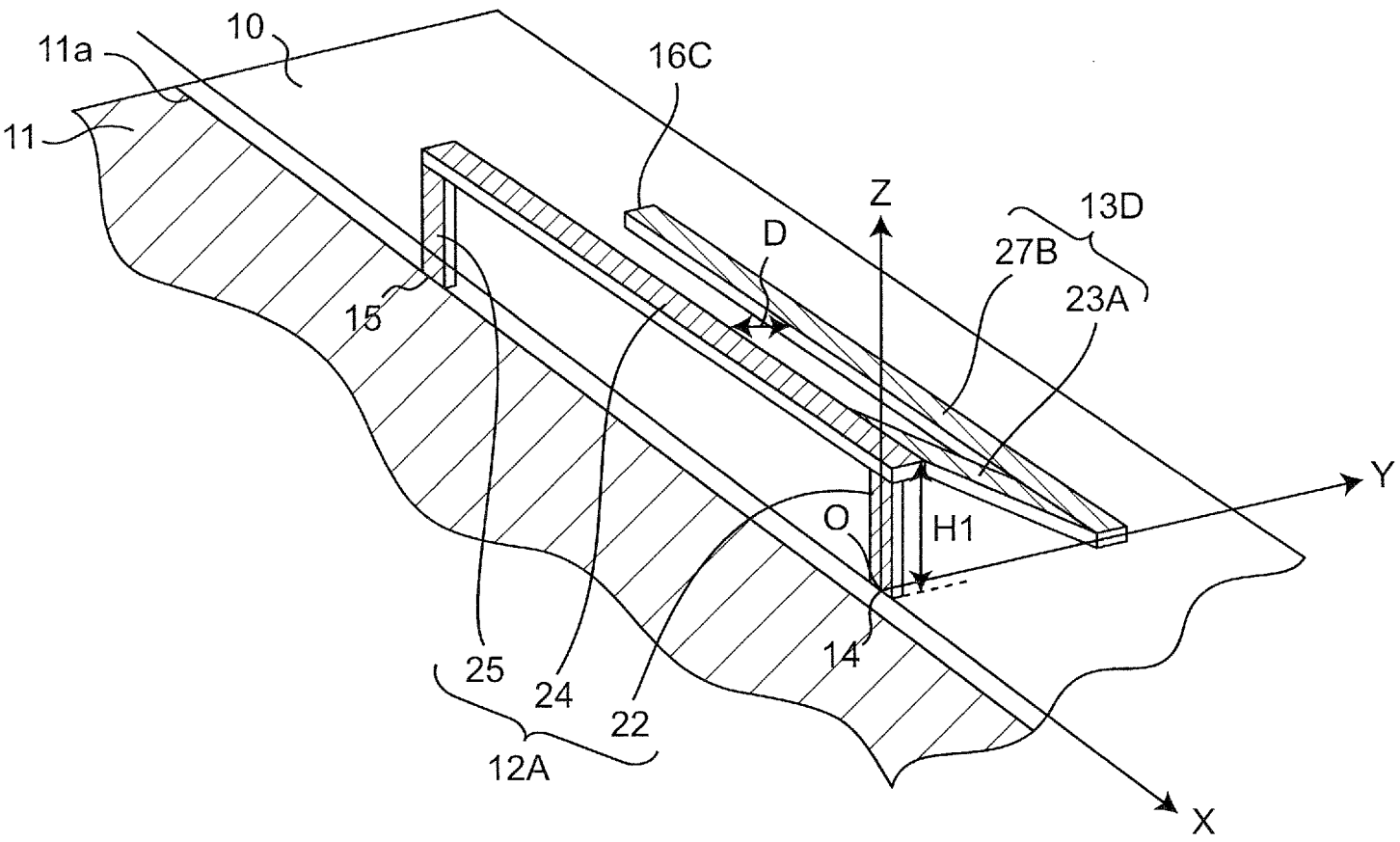
FIG. 10 is a perspective view showing a configuration of an antenna apparatus 100E according to a third preferred embodiment of the present disclosure.

The seventh strip conductors 27 and 27A are formed in the position at the height H1 from the dielectric substrate 10 in the above-described preferred embodiments and the modified preferred embodiments, however, the present disclosure is not limited to this. The seventh strip conductors 27 and 27A may be formed on the dielectric substrate 10. FIG. 10 is a perspective view showing a configuration of an antenna apparatus 100E according to the third preferred embodiment of the present disclosure.

Referring to FIG. 10, the antenna apparatus 100E is configured to include the dielectric substrate 10, the grounding conductor 11, the first antenna element 12A, and a second antenna element 13D. In this case, the first antenna element 12A is configured to include the second strip conductor 22, the fourth strip conductor 24, and the fifth strip conductor 25. The first antenna element 12A of the present preferred embodiment is configured in a manner similar to that of the first antenna element 12A (See FIG. 6) of the antenna apparatus 100A of the first modified preferred embodiment of the first preferred embodiment, and therefore, no description is provided therefor. In addition, the second antenna element 13D is configured to include a third strip conductor 23A, and a seventh strip conductor 27B.

Referring to FIG. 10, the second antenna element 13D is configured to include the third strip conductor 23A and the seventh strip conductor 27B. The third strip conductor 23A extends in the Y-axis direction and the −Z-axis direction from its one end connected to the fourth strip conductor 24, to its another end provided on the Y axis. The third strip conductor 23A is inclined in the Y-axis direction with respect to the dielectric substrate 10. Further, the seventh strip conductor 27B extends in the −X-axis direction from its one end connected to another end of the third strip conductor 23A to an open end 16C on the dielectric substrate 10.

Referring to FIG. 10, the fourth strip conductor 24 and the seventh strip conductor 27B are formed to be substantially parallel to each other at a distance D. In this case, the distance D is equal to the length of the third strip conductor 23A. The distance D and the height H1 of the fourth strip conductor 24 from the dielectric substrate 10 are each set in a manner similar to that of the first preferred embodiment.

The antenna apparatus 100E configured as described above has a first radiating element that can transmit and receive a wireless signal having a wireless frequency of a resonance frequency fh, and a second radiating element that can transmit and receive a wireless signal having a wireless frequency of a resonance frequency f1. In this case, the first radiating element of the present preferred embodiment is identical to the first radiating element of the antenna apparatus 100A of the first modified preferred embodiment of the first preferred embodiment, and therefore, no description is provided therefor. In addition, the second radiating element is an inverted-F antenna having a main body part of the second antenna element 13D, a feeding part of the second strip conductor 22, and a short-circuit part from a connecting point between the second strip conductor 22 and the fourth strip conductor 24 via the fourth strip conductor 24 and the fifth strip conductor 25 to the grounding point 15. In this case, the electrical length of the portion from the feeding point 14 via the second strip conductor 22, the third strip conductor 23A and the seventh strip conductor 27B to the open end 16 is set to λ¼, that is substantially a quarter of the wavelength λ1.

The antenna apparatus 100D of the present preferred embodiment exhibits action and advantageous effects similar to those of the antenna apparatus 100 of the first preferred embodiment. Further, since the seventh strip conductor 27B is formed on the dielectric substrate 10 according to the present preferred embodiment, the size of the entire antenna apparatus 100E can be reduced as compared with the first preferred embodiment.

Fourth Modified Preferred Embodiment of First Preferred Embodiment

Figure 11:
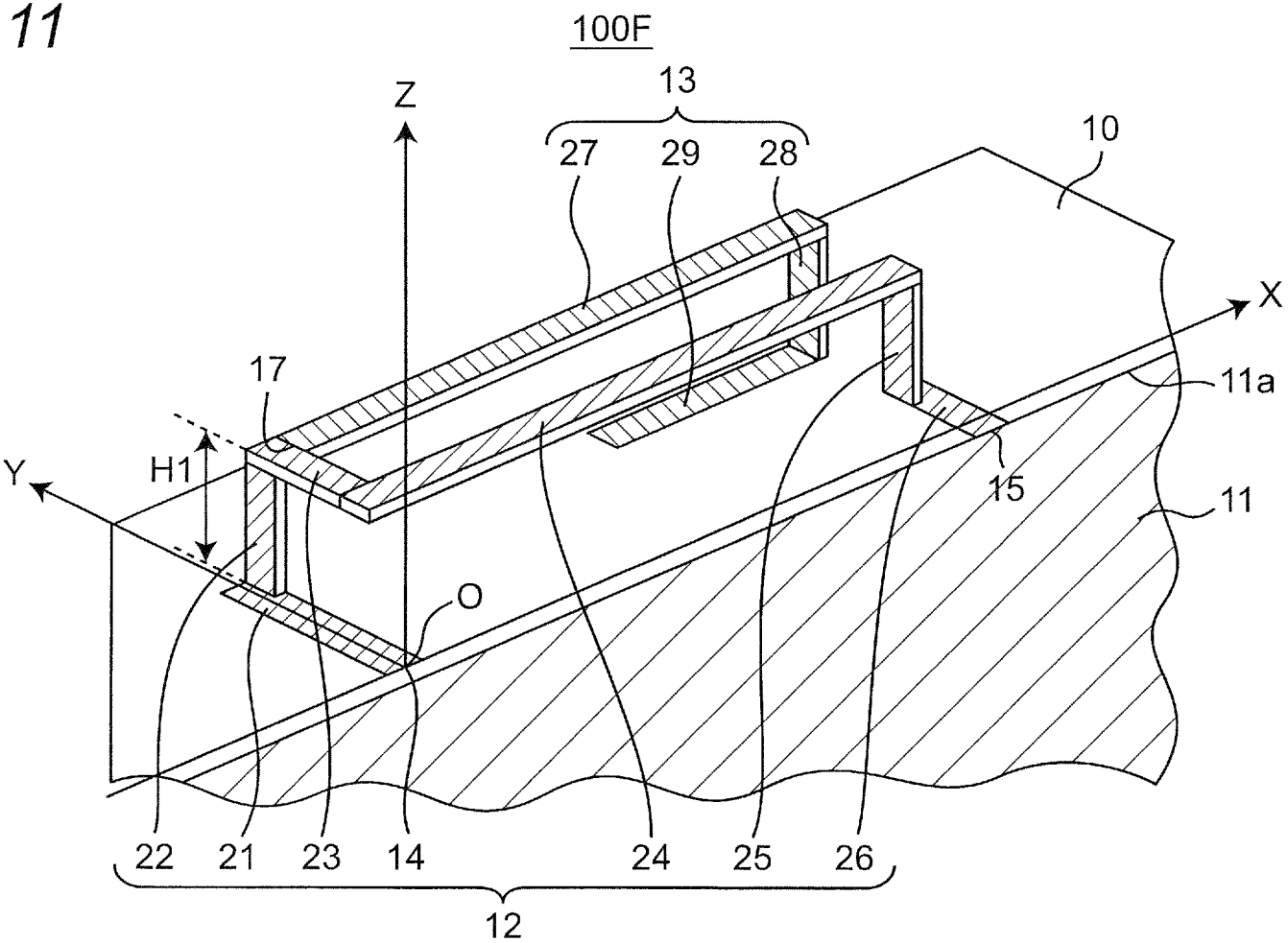
FIG. 11 is a perspective view showing a configuration of an antenna apparatus 100F according to a fourth modified preferred embodiment of the first preferred embodiment of the present disclosure.

FIG. 11 is a perspective view showing a configuration of an antenna as apparatus 100F according to the fourth modified preferred embodiment of the first preferred embodiment of the present disclosure. The antenna apparatus 100F of the present modified preferred embodiment is a mirror image about the YZ plane of the antenna apparatus 100 of the first preferred embodiment. The second strip conductor 22 and the fifth strip conductor 25 are formed on the planes parallel to the ZX plane in the antenna apparatus 100, however, the second fifth strip conductor 22 and the fifth strip conductor 25 are formed on planes parallel to the YZ plane in the antenna apparatus 100F. The antenna apparatus 100F is configured in a manner similar to that of the antenna apparatus 100 in the points other than this. The antenna apparatus 100F of the present preferred embodiment exhibits action and advantageous effects similar to those of the antenna apparatus 100 of the first preferred embodiment.

Fourth Preferred Embodiment

Figure 12:
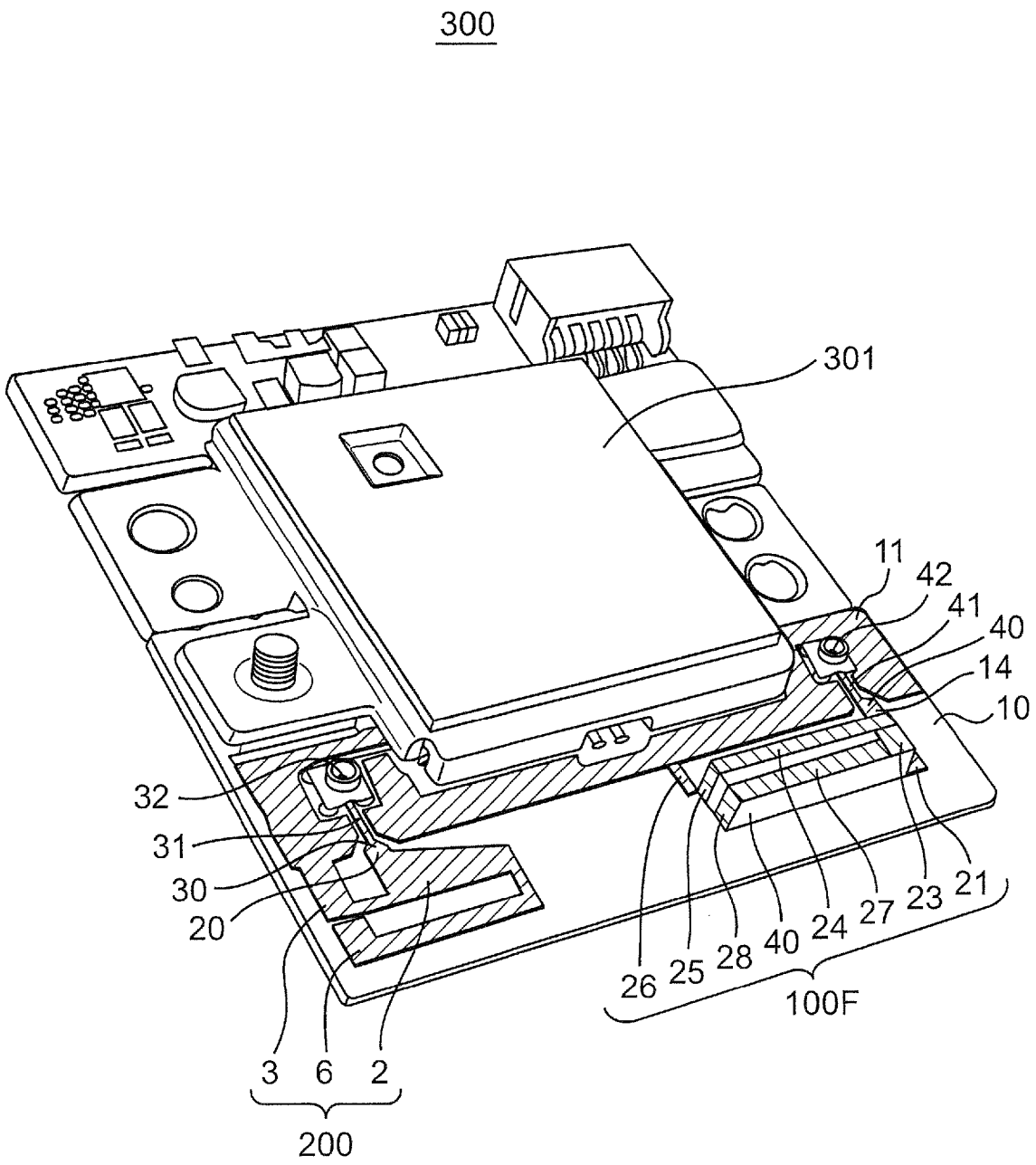
FIG. 12 is a perspective view showing a configuration of a wireless communication apparatus 300 according to a fourth preferred embodiment of the present disclosure.

FIG. 12 is a perspective view showing a configuration of a wireless communication apparatus 300 according to the fourth preferred embodiment of the present disclosure. Referring to FIG. 12, the wireless communication apparatus 300 is, for example, a wireless communication apparatus of a 2×2 MIMO (Multiple Input Multiple Output) communication system complying with the wireless LAN communication standard IEEE802.11n. The wireless communication apparatus 300 is configured to include the grounding conductor 11, the antenna apparatus 100F, an antenna apparatus 200, and a wireless transceiver circuit 301. The wireless transceiver circuit 301 is mounted on the dielectric substrate 10, and executes MIMO processing for each wireless signal transmitted and received by the antenna apparatuses 100F and 200. In addition, as shown in FIG. 12, the antenna apparatus 100F includes a rectangular parallelepiped 40 made of a dielectric material, and the second to fifth strip conductors 22 to 25, the seventh strip conductor 27 and the eighth strip conductor 28 are formed as conductor patterns on the respective surfaces of the rectangular parallelepiped 40.

In addition, referring to FIG. 12, the feeding point 14 of the antenna apparatus 100F is connected to a central conductor 42 of a coaxial cable via an impedance converter circuit 40 made of a tapered conductor, and a strip conductor 41 of a coplanar line. Further, a feeding point 20 of the antenna apparatus 200 is connected to a central conductor 32 of a coaxial cable via an impedance converter circuit 30 made of a tapered conductor, and a strip conductor 31 of a coplanar line.

Figure 13:
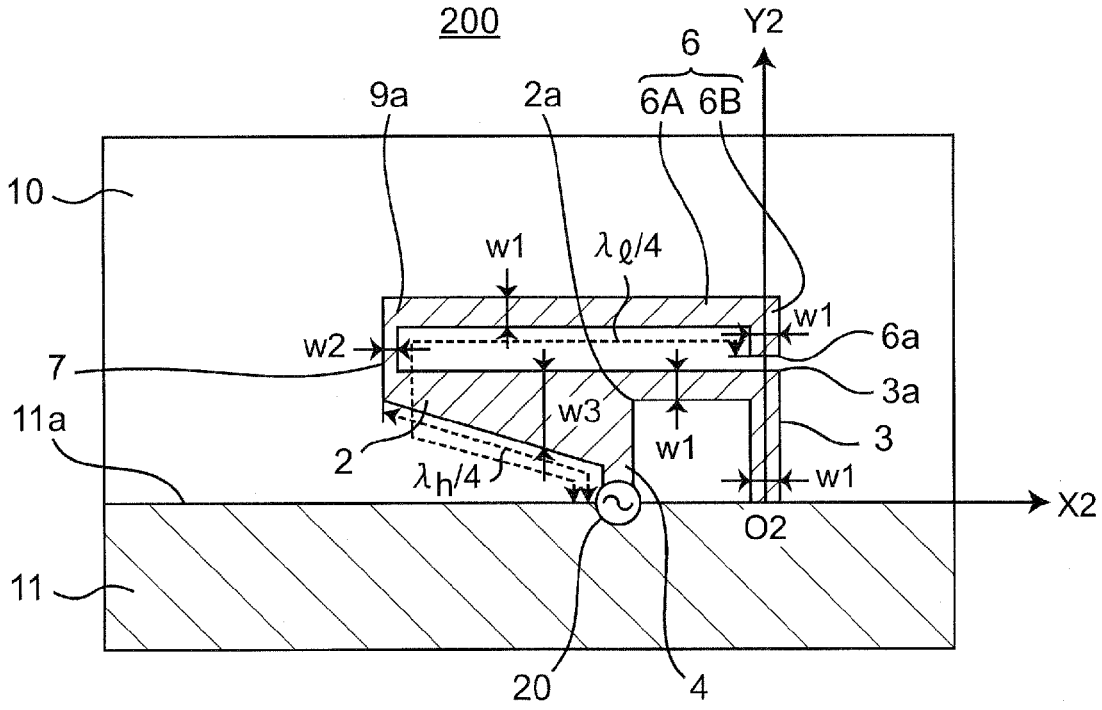
FIG. 13 is a plan view showing a configuration of the antenna apparatus 200 of FIG. 12.

FIG. 13 is a plan view showing a configuration of the antenna apparatus 200 of FIG. 12. Referring to FIG. 13, each antenna apparatus is described below by using XY coordinates such that one point on the upper surface of the grounding conductor 11 formed on the dielectric substrate 10 is defined as a coordinate origin O2. An axis along the edge portion 11*a* of the grounding conductor 11 is defined as an X2 axis, and an axis from the coordinate origin O2 upward in FIG. 13 from the edge portion 11*a* of the grounding conductor 11 is defined as a Y2 axis. In this case, a direction opposite to the X2-axis direction is referred to as a −X2-axis direction, and a direction opposite to the Y2-axis direction is referred to as a −Y2-axis direction.

Referring to FIG. 13, the antenna apparatus 200 is configured to include the grounding conductor 11, an antenna element 2, a grounded antenna element 3, a feeding antenna element 4, a feeding point 20, an antenna element 6, and an antenna element 7. The antenna elements 2 to 7 and the grounding conductor 11 are made of conductive foils of Cu, Ag or the like formed on the dielectric substrate 10. It is noted that a grounding conductor may be or may not be formed on a back surface of the dielectric substrate 10 opposing to the grounding conductor 11. In addition, no grounding conductor is formed on the back surface of the dielectric substrate 10 where the antenna apparatus including the antenna elements 2 to 7 are formed. Further, the grounding conductor 11 is preferably formed so that its extension length in the Y2-axis direction becomes longer than the wavelength λ1. The grounding conductor 11 needs not be formed in a case where grounding is achieved at another end of a feeding line when feeding is performed from the feeding point 20 via the feeding line. However, it is preferred to form the grounding conductor 11 when radiation from the antenna apparatus is performed with comparatively high efficiency.

One end of the feeding antenna element 4 is connected to the feeding point 20, and the feeding antenna element 4 is formed to be substantially parallel to the Y2-axis direction. After extending in the Y2-axis direction, another end of the feeding antenna element 4 is connected to a predetermined connecting point 2*a* of the antenna element 2. One end of the grounded antenna element 3 is connected to the grounding conductor 11 at the coordinate origin O2, and the grounded antenna element 3 is formed along the Y2-axis direction. After extending in the Y2-axis direction, another end of the grounded antenna element 3 is connected to one end of the antenna element 2. The antenna element 2 is formed to be substantially parallel to the X2 axis, and after extending in the −X2-direction from its one end connected to another end (upper end in the figure) of the grounded antenna element 3 via the connecting point 2*a*, another end of the antenna element 2 is connected to one end of the antenna element 7. The antenna element 7 extends in the Y2-axis direction from another end of the antenna element 2, and then, is connected to one end 9*a* of the antenna element 6. The antenna element 6 is formed to be substantially parallel to the X2-axis direction, and after extending in the −X2-axis direction from another end of the antenna element 7, bent and extended in the −Y2-axis direction at a point intersecting the Y2 axis. An open end of the antenna element 6 is formed to be adjacent to and to be electromagnetically coupled to another end 3*a* of the grounded antenna element 3. In this case, the antenna element 6 is configured to include an element portion 6A parallel to the X2-axis direction and an element portion 6B parallel to the Y2-axis direction, and a coupling capacitor is generated between the open end of the element portion 6B and another end of the grounded antenna element 3. The shape of the antenna element 2 extending in the −X2-axis direction is illustrated as an example, however, the antenna element 2 may have a shape extending in the X2-axis direction.

In the antenna apparatus configured as described above, the antenna element 2 and the antenna element 6 are formed to be substantially parallel to each other, and substantially parallel to the line of the outer edge portion 11*a* of the grounding conductor 11 formed along the −X2 axis. In addition, the feeding antenna element 4, the grounded antenna element 3, and the antenna element 7 are formed to be substantially parallel to the Y2-axis direction.

The antenna apparatus 200 configured as described above includes third to fifth radiating elements. As shown in FIG. 13, the third radiating element is configured to include an antenna element from the feeding point 20 to another end of the antenna element 2, via the feeding antenna element 4, the connecting point 2*a* and antenna element 2. A length (electrical length) of the third radiating element is set to λh/4 that is a quarter wavelength of the wavelength λh. The third radiating element resonates at the resonance frequency fh, and is able to transmit and receive a wireless signal having a wireless frequency of the resonance frequency fh. It is noted that the resonance frequency fh is set by an electrical length from the feeding point 20 to the connecting point between the antenna element 2 and the antenna element 7, for example, along the edge of the antenna element 2.

In addition, the fourth radiating element is configured to include an antenna element from the feeding point 20 to the open end of the antenna element 6, via the feeding antenna element 4, the connecting point 2*a*, the antenna element 2, another end of the antenna element 2, the antenna element 7, and the antenna element 6. A length (electrical length) of the fourth radiating element is set to λ¼ that is a quarter wavelength of the wavelength λ1. The fourth radiating element resonates at the resonance frequency f1, and is able to transmit and receive a wireless signal having a wireless frequency of the resonance frequency f1. It is noted that the resonance frequency f1 is set by an electrical length from the feeding point 20 to a tip end of the antenna element 6, via the edge of the antenna element 2, the connecting point between the antenna element 2 and the antenna element 7, the antenna element 7, and the antenna element 6.

Further, the fifth radiating element is configured to include an antenna element extending from the feeding point 20 to the grounding conductor 11, via the feeding antenna element 4, the antenna element 2 (limited to the portion on the left-hand side from the connecting point 2*a* in the figure), the antenna element 7, the antenna element 6, the above-described coupling capacitor, and the grounded antenna element 3. A length (electrical length) of the fifth radiating element is set to become λh/2 (the length may be 3λh/4) that is a half wavelength of the wavelength λh. The fifth radiating element can operate as a so-called loop antenna, which utilizes a mirror image generated in the grounding conductor 11, and transmits and receives a wireless signal at the wireless frequency having the resonance frequency fh in a manner similar to that of the third radiating element.

In addition, each of the antenna elements 2, 3, 4 and 6 has a predetermined width w1, and the antenna element 7 has a predetermined width w2. In this case, when the function of the loop antenna is used, the widths w1 and w2 are set to the same widths as each other. It is noted that, when the function of the loop antenna is not used, the widths w1 and w2 are preferable set so that an impedance becomes higher than a predetermined threshold impedance for the frequency of the resonance frequency fh, and becomes lower than the threshold impedance for the resonance frequency f1. Further, the antenna element 2 is made to have a tapered shape such that its width w3 is gradually increased from its another end (left end) toward its one end in the X2-axis direction to the connecting points 2*a*.

Further, the position of the connecting point 2*a* on the antenna element 2 and the width w1 are set so that an impedance when seen from the feeding point 20 via the feeding line (not shown) to the wireless transceiver circuit 301 substantially coincides with an impedance when seen from the feeding point 20 to the antenna apparatus 200 on the antenna element 2 side. It is noted that, for example, a coaxial cable, a microstrip line or the like is used as the feeding line.

As described above, the antenna apparatus 200 is a dual-band antenna that can support two frequency bands for use in the wireless LAN in a manner similar to that of the antenna apparatus 100F, and resonates at the resonance frequency f1 of the low frequency band and the resonance frequency fh (when f1<fh) of the high frequency band. Therefore, according to the present preferred embodiment, MIMO processing can be performed for the wireless signals received by the antenna apparatuses 100F and 200.

The wireless communication apparatus 300 includes the antenna apparatus 100F in the present preferred embodiment, however, the present disclosure is not limited to this, and the wireless communication apparatus 300 may includes the antenna apparatus 100, 100A, 100B, 100C, 100D or 100E.

It is acceptable to constitute an antenna apparatus by combining the first antenna element 12 with the second antenna element 13D, constitute an antenna apparatus by combining the first antenna element 12A with the second antenna element 13D, or constitute an antenna apparatus by combining the first antenna element 12B with the second antenna elements 13A, 13B, 13C or 13D.

In addition, the antenna apparatuses 100 to 100F transmit and receive radio waves in the 2.4-GHz band and the 5-GHz band in the above-described preferred embodiments and the modified preferred embodiments, however, the present disclosure is not limited to this, and radio waves in arbitrary two frequency bands may be transmitted and received.

Further, the grounding conductor 10 is formed on the surface of the dielectric substrate 11 in the above-described preferred embodiments and modified preferred embodiments, however, the present disclosure is not limited to this. It is acceptable to form the grounding conductor 10 on the back surface of the dielectric substrate 11 and connect the grounding point 15 with the grounding conductor 10 by using, for example, a via conductor.

As described above, according to the antenna apparatus of the present disclosure, the first antenna element includes the first element portion, and the second antenna element includes the second element portion. Therefore, it is possible to provide a dual-band antenna apparatus having a size smaller than that of the prior art, and capable of securing a desired fractional band-width in a low frequency band, providing a satisfactory antenna gain in each of the frequency bands, and providing a substantially omni-directional directional pattern in a high frequency band.

The antenna apparatus of the present disclosure can be widely applied to antenna apparatuses for wireless communication equipment that utilizes a plurality of frequency bands, such as mobile communication equipment adopting the GSM (registered trademark)·W-CDMA (Wideband Code Division Multiple Access) system without being limited to the equipment on which the wireless LAN function is mounted.

Although the present disclosure has been fully described in connection with the preferred embodiments thereof with reference to the accompanying drawings, it is to be noted that various changes and modifications are apparent to those skilled in the art. Such changes and modifications are to be understood as included within the scope of the present disclosure as defined by the appended claims unless they depart therefrom.

What is claimed is:

1. An antenna apparatus of an inverted-F antenna comprising:

a first antenna element of a loop antenna, having one end connected to a first feeding point and another end connected to a grounding conductor formed on a dielectric substrate, and resonating at a predetermined first wavelength; and a second antenna element having one end connected to a predetermined connecting portion of the first antenna element and another end of an open end, wherein the inverted-F antenna resonates at a predetermined second wavelength longer than the first wavelength, wherein the first antenna element includes a first element portion formed to have a predetermined first height from a surface of the dielectric substrate, and wherein the second antenna element includes a second element portion which is formed to have the first height from the surface of the dielectric substrate, and is formed to be substantially parallel to the first element portion at a predetermined distance apart from the first antenna element, wherein the first antenna element comprises:

a first strip conductor, that has one end connected to the first feeding point, and extends in a predetermined first direction from the one end of the first strip conductor on the dielectric substrate;

a second strip conductor, that has one end connected to another end of the first strip conductor, and extends from the one end of the second strip conductor in a predetermined second direction perpendicular to the surface of the dielectric substrate;

a third strip conductor, that has one end connected to another end of the second strip conductor, and extends from the one end of the third strip conductor in a direction opposite to the first direction;

a fourth strip conductor, that has one end connected to another end of the third strip conductor, and extends from the one end of the fourth strip conductor in a third direction perpendicular to the first and second directions;

a fifth strip conductor, that has one end connected to another end of the fourth strip conductor, and extends from the one end of the fifth strip conductor to the surface of the dielectric substrate in a direction opposite to the second direction; and a sixth strip conductor, that has one end connected to another end of the fifth strip conductor and another end connected to the grounding conductor, wherein the second antenna element comprises:

a seventh strip conductor, that has one end connected to a connecting point between the second and third strip conductors, and extends from the one end of the seventh strip conductor in the third direction;

an eighth strip conductor, that has one end connected to another end of the seventh strip conductor, and extends from the one end of the eighth strip conductor to the surface of the dielectric substrate in a direction opposite to the second direction; and a ninth strip conductor, that has one end connected to another end of the eighth strip conductor, and extends from the one end of the ninth strip conductor to the open end in a direction opposite to the third direction, wherein the first element portion is the fourth strip conductor, and wherein the second element portion is the seventh strip conductor.

2. The antenna apparatus as claimed in claim 1, wherein the distance is set to equal to or larger than 1/250 of the second wavelength.

3. The antenna apparatus as claimed in claim 2, wherein the first height is set to equal to or larger than 1/20 of the first wavelength.

4. An antenna system comprising first and second antenna apparatus, wherein the first antenna apparatus is an inverted-F antenna comprising:

a first antenna element of a loop antenna, having one end connected to a first feeding point and another end connected to a grounding conductor formed on a dielectric substrate, and resonating at a predetermined first wavelength; and a second antenna element having one end connected to a predetermined connecting portion of the first antenna element and another end of an open end, wherein the inverted-F antenna resonates at a predetermined second wavelength longer than the first wavelength, wherein the first antenna element includes a first element portion formed to have a predetermined first height from a surface of the dielectric substrate, and wherein the second antenna element includes a second element portion which is formed to have the first height from the surface of the dielectric substrate, and is formed to be substantially parallel to the first element portion at a predetermined distance apart from the first antenna element, wherein the second antenna apparatus comprises:

a grounded antenna element having one end connected to the grounding conductor;

a third antenna element that is formed to be substantially parallel to an edge portion of the grounding conductor, and has one end connected to another end of the grounded antenna element;

a feeding antenna element that connects a second feeding point with a predetermined connecting point on the third antenna element;

a fifth antenna element that has one end connected to another end of the third antenna element; and a fourth antenna element that has one end connected to another end of the fifth antenna element, wherein another end of the fourth antenna element is folded, so that another end of the fourth antenna element is adjacent to and electromagnetically coupled to another end of the grounded antenna element to form a coupling capacitor between the fourth antenna element and the grounded antenna element, wherein a first length, from the second feeding point via the feeding antenna element, the connecting point on the third antenna element and the third antenna element to another end of the third antenna element, is set to a length of a quarter wavelength of a first resonance frequency, so as to resonate a first radiating element having the first length at the first resonance frequency, wherein a second length, from the second feeding point via the feeding antenna element, the connecting point on the third antenna element, the third antenna element, the fifth antenna element and the fourth antenna element to another end of the fourth antenna element, is set to a length of a quarter wavelength of the second resonance frequency, so as to generate a second radiating element having the second length at the second resonance frequency, wherein a third length, from the second feeding point via the feeding antenna element, the connecting point on the third antenna element, the third antenna element, the fifth antenna element, the fourth antenna element and the coupling capacitor to the grounded antenna element, is set to one of a half wavelength and three quarter wavelength of the first resonance frequency, so as to resonate a third radiating element, which has the third length and configures a loop antenna, at the first resonance frequency, and wherein the third antenna element is formed so that a width of the third antenna element expands gradually in a tapered shape, from another end of the third antenna element to the connecting point between the third antenna element and the feeding antenna element.

* * * * *